US009718270B2

(12) United States Patent
Kida

(10) Patent No.: US 9,718,270 B2
(45) Date of Patent: Aug. 1, 2017

(54) LIQUID DISCHARGE HEAD, LIQUID DISCHARGE DEVICE, AND LIQUID DISCHARGE APPARATUS

(71) Applicant: Hitoshi Kida, Kanagawa (JP)

(72) Inventor: Hitoshi Kida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/806,810

(22) Filed: Jul. 23, 2015

(65) Prior Publication Data

US 2016/0031212 A1 Feb. 4, 2016

(30) Foreign Application Priority Data

Aug. 1, 2014 (JP) ..... 2014-158071
Mar. 16, 2015 (JP) ..... 2015-052579

(51) Int. Cl.
*B41J 2/045* (2006.01)
*B41J 2/14* (2006.01)

(52) U.S. Cl.
CPC .. *B41J 2/14233* (2013.01); *B41J 2002/14491* (2013.01); *B41J 2202/18* (2013.01); *B41J 2202/21* (2013.01)

(58) Field of Classification Search
None
See application file for complete search history.

(56) References Cited

U.S. PATENT DOCUMENTS

2002/0012029 A1* 1/2002 Miyata ..... B41J 2/14233 347/68
2007/0176975 A1 8/2007 Ueno
2010/0188448 A1 7/2010 Kida
2011/0074885 A1* 3/2011 Usui ..... B41J 2/14233 347/50
2011/0228006 A1 9/2011 Kida
2012/0069095 A1 3/2012 Kida et al.
2012/0212547 A1 8/2012 Takemoto et al.
2012/0229542 A1 9/2012 Kida
(Continued)

FOREIGN PATENT DOCUMENTS

JP 7-186378 7/1995
JP 2004-017600 1/2004
(Continued)

*Primary Examiner* — Erica Lin
(74) *Attorney, Agent, or Firm* — Cooper & Dunham LLP

(57) ABSTRACT

A liquid discharge head includes a plurality of nozzles to discharge liquid droplets; a plurality of piezoelectric elements, each corresponding to a corresponding one of the plurality of nozzles and disposed along a nozzle alignment direction along which the plurality of nozzles is aligned; an actuator member on which the plurality of piezoelectric elements is aligned; and wiring disposed along the nozzle alignment direction, connected to the plurality of piezoelectric elements, and included in the actuator member, the wiring including a first wiring pattern to which the plurality of piezoelectric elements is connected, the first wiring pattern including a near side proximal to and a far side distal from a source of a drive signal for the piezoelectric elements. The near side and the far side are connected via a second wiring pattern.

15 Claims, 20 Drawing Sheets

(56) References Cited

U.S. PATENT DOCUMENTS

| | | | | |
|---|---|---|---|---|
| 2012/0320131 | A1* | 12/2012 | Kato | B41J 2/14233 347/85 |
| 2014/0022305 | A1 | 1/2014 | Kida | |
| 2015/0029270 | A1 | 1/2015 | Takemoto et al. | |
| 2015/0070421 | A1 | 3/2015 | Kida | |

FOREIGN PATENT DOCUMENTS

| | | |
|---|---|---|
| JP | 2005-144851 | 6/2005 |
| JP | 2007-230211 | 9/2007 |
| JP | 2009-154519 | 7/2009 |

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

The present application claims priority pursuant to 35 U.S.C. §119 from Japanese patent application numbers 2014-158071 and 2015-052579, filed on Aug. 1, 2014, and Mar. 16, 2015, respectively, the entire disclosures of which are incorporated by reference herein.

BACKGROUND

Technical Field

The present invention relates to a liquid discharge head, a liquid discharge device, and a liquid discharge apparatus.

Background Art

As an image forming apparatus, for example, an inkjet recording apparatus is known that forms images with a liquid discharge head that discharges liquid droplets.

The liquid discharge head includes a plurality of nozzles to discharge liquid droplets and a plurality of pressure generators corresponding to each nozzle. An electrode used as a pressure generator is connected to power electrode wiring via a switch to select a pressure generator for driving the liquid discharge head. A common electrode connecting two or more pressure generators is connected to a common power electrode wiring or wiring for a common electrode.

To reduce unevenness in the liquid discharging due to the resistance of the wiring itself, a plurality of nozzle arrays may be divided into blocks, for example, a primary common wiring electrode is provided to each block, and a secondary common wiring electrode connects the primary common wiring electrodes to each other.

SUMMARY

One embodiment of the disclosure provides a liquid discharge head includes a plurality of nozzles to discharge liquid droplets; a plurality of piezoelectric elements, each corresponding to a corresponding one of the plurality of nozzles and disposed along a nozzle alignment direction along which the plurality of nozzles is aligned; an actuator member on which the plurality of piezoelectric elements is aligned; and wiring disposed along the nozzle alignment direction, connected to the plurality of piezoelectric elements, and included in the actuator member, the wiring including a first wiring pattern to which the plurality of piezoelectric elements is connected, the first wiring pattern including a near side proximal to and a far side distal from a source of a drive signal for the piezoelectric elements. The near side and the far side are connected via a second wiring pattern.

Other embodiments of the disclosure provide a liquid discharge device, and a liquid discharge apparatus including the above liquid discharge head.

These and other objects, features, and advantages of the present invention will become apparent upon consideration of the following description of the preferred embodiments of the present invention when taken in conjunction with the accompanying drawings.

DETAILED DESCRIPTION

In a configuration in which the electrode wiring pattern is provided along the plurality of pressure generators in the nozzle alignment direction, and a drive waveform or a drive signal is supplied from one side, the number of nozzles simultaneously driven increases. However, due to a voltage drop caused by resistance in the wiring, there are variations in the speed and volume of the discharged droplets by block depending on the location of the nozzle, that is, between the nozzle of which the pressure generator is disposed near the supply side of the drive signal and the nozzle of which the pressure generator is disposed away from the supply side of the drive signal.

Moreover, if the resistance of the primary common wiring electrode itself is large, the liquid discharging properties of each block fluctuate and the device configuration becomes complicated.

In light of the above-described circumstances, as described below, at least one embodiment of the present disclosure provides improved image quality using an uncomplicated structure by reducing uneven liquid discharge.

An example of a droplet discharge head according to the present invention will be described with reference to FIGS. 1 through 3.

Figure 1:
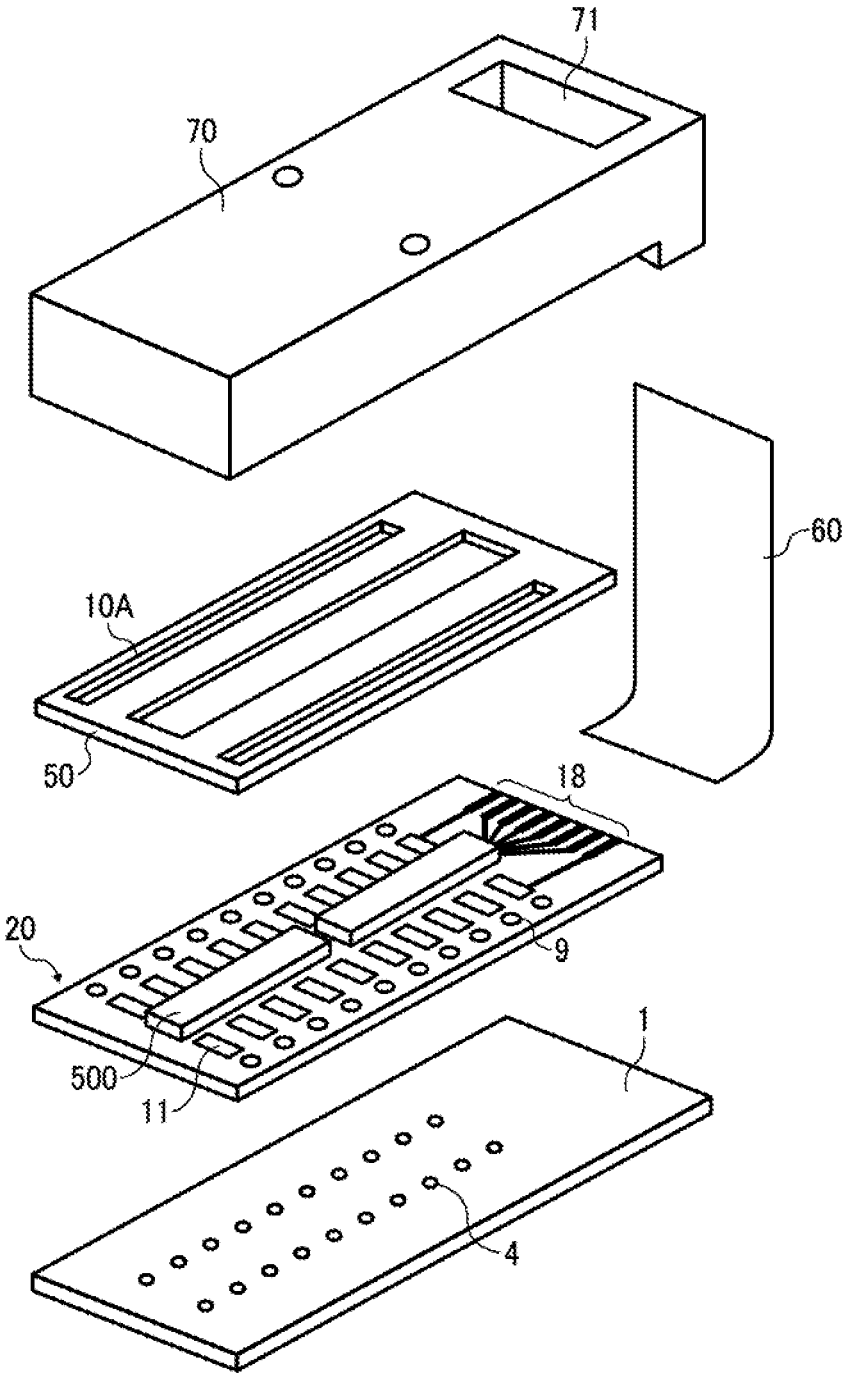
FIG. 1 is an exploded view of a liquid discharge head according to an embodiment of the present invention.
Figure 2:
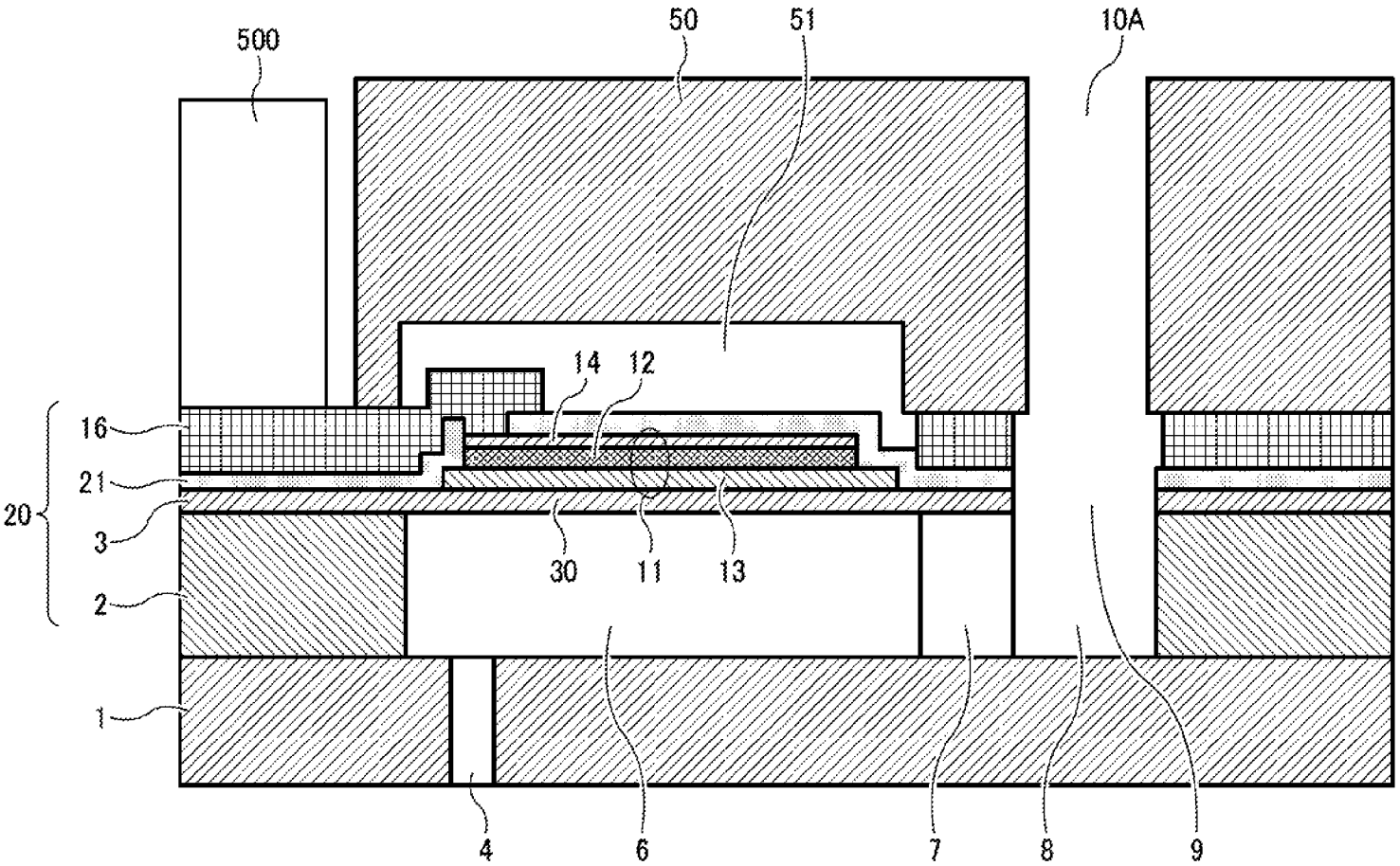
FIG. 2 is a cross-sectional view of the liquid discharge head of FIG. 1 illustrating a principal part thereof, along a direction perpendicular to a nozzle alignment direction.
Figure 3:
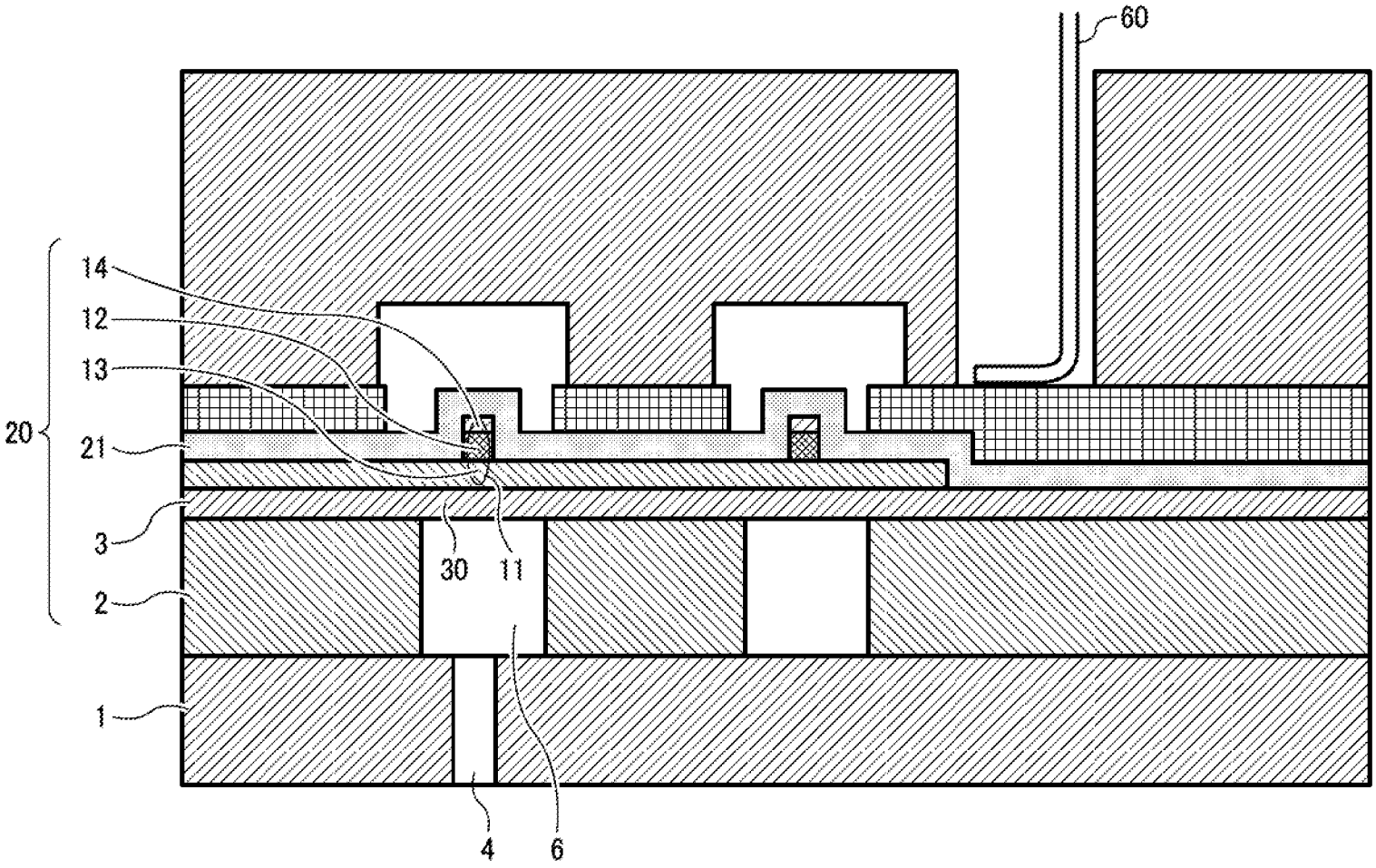
FIG. 3 is a cross-sectional view of the liquid discharge head of FIG. 1 illustrating a principal part thereof, along the nozzle alignment direction.

FIG. 1 is an exploded view of a liquid discharge head, FIG. 2 is a cross-sectional view of the liquid discharge head along a direction perpendicular to a nozzle alignment direction, and FIG. 3 is a cross-sectional view of the same along the nozzle alignment direction.

The liquid discharge head includes a nozzle plate 1, a channel plate 2, a diaphragm 3, a piezoelectric element 11 as a pressure generator, a retainer substrate 50, and a frame 70 (shown in FIG. 1) serving also as a common liquid chamber.

In the present embodiment, the channel plate 2, the diaphragm 3, and the piezoelectric element 11 together form an actuator substrate 20. The actuator substrate 20 once completely formed as an independent member is not meant to include further addition of the nozzle plate 1, the retainer substrate 50, the frame 70, and the like.

A plurality of nozzles 4 that discharges liquid droplets is disposed in the nozzle plate 1. Herein, two nozzle arrays each including a plurality of nozzles 4 are disposed.

The channel plate 2 together with the nozzle plate 1 and the diaphragm 3 form an individual liquid chamber 6 with which each nozzle 4 communicates, a fluid resistor 7 that communicates with the individual liquid chamber 6, and a liquid inlet 8 with which the fluid resistor 7 communicates.

The liquid inlet 8 communicates with a common liquid chamber formed by the frame 70, via a supply port 9 of the diaphragm 3 and an orifice manifold 10A, part of the common liquid chamber of the retainer substrate 50.

The diaphragm 3 forms a deformable vibrating area 30, part of the wall of the individual liquid chamber 6. The piezoelectric element 11 is disposed integrally with the vibrating area 30, so that the vibrating area 30 and the piezoelectric element 11 together form a piezoelectric actuator.

The piezoelectric element 11 is constructed of, from a side of the vibrating area 30, a lower electrode 13, a piezoelectric layer 12, and an upper electrode 14, sequentially laminated in this order. An interlayer insulation film 21 is formed on the piezoelectric element 11.

The lower electrode 13 of the piezoelectric element 11 is connected to a joint pad via a common wiring. The upper electrode 14 is connected to a driver IC 500 by an individual wire 16.

The driver IC 500 includes switching elements that serve as a plurality of selectors to select the piezoelectric element to which a drive signal is to be applied among the plurality of pressure generators, that is, the piezoelectric elements 11.

The driver IC 500 is so mounted on the actuator substrate 20 as to cover an area between arrays of piezoelectric elements 11, using any method of flip chip bonding or wire bonding.

As illustrated in FIG. 1, wires are led out from an input/output terminal of the I/O of the driver IC 500 mounted on the actuator substrate 20, or from an input terminal of the power source terminal or the drive waveform/signal, to a group of connection terminals 18.

Wiring member 60 such as flexible printed circuit (FPC) or flexible flat cable (FFC) is electrically connected to each connection terminal of the group of connection terminals 18 via anisotropic conductive film (ACF) connection, solder connection, and wire bonding, and another terminal of the wiring member 60 is connected to a controller.

The wiring member 60 is contained within the frame 70, and is led out from a lead-out port 71 to outside the head. In addition, each connection terminal of the group of connection terminals 18 is disposed flat against an end of the actuator substrate 20 flatly.

Then, the retainer substrate 50 that forms a concave vibration chamber 51 accommodating the piezoelectric element 11 is disposed on the actuator substrate 20.

The retainer substrate 50 also forms part of the common liquid chamber or the orifice manifold 10A. The retainer substrate 50 is bonded with an adhesive to a side of the diaphragm 3 of the actuator substrate 20.

In the thus-configured liquid discharge head, voltage is applied from the driver IC 500 to a portion between the upper electrode 14 and the lower electrode 13 of the piezoelectric element 11, so that the piezoelectric layer 12 expands in a direction in which the electrodes are layered, that is, in a direction of the electric field, and shrinks in a direction parallel to the vibrating area 30.

At this time, because the lower electrode 13 is retained by the vibrating area 30, tensile force is generated in a side of the lower electrode 13 of the vibrating area 30. As a result, the vibrating area 30 is bent toward the individual liquid chamber 6 and the liquid inside the individual liquid chamber 6 is compressed, so that the liquid droplets are discharged from the nozzle 4.

Figure 4:
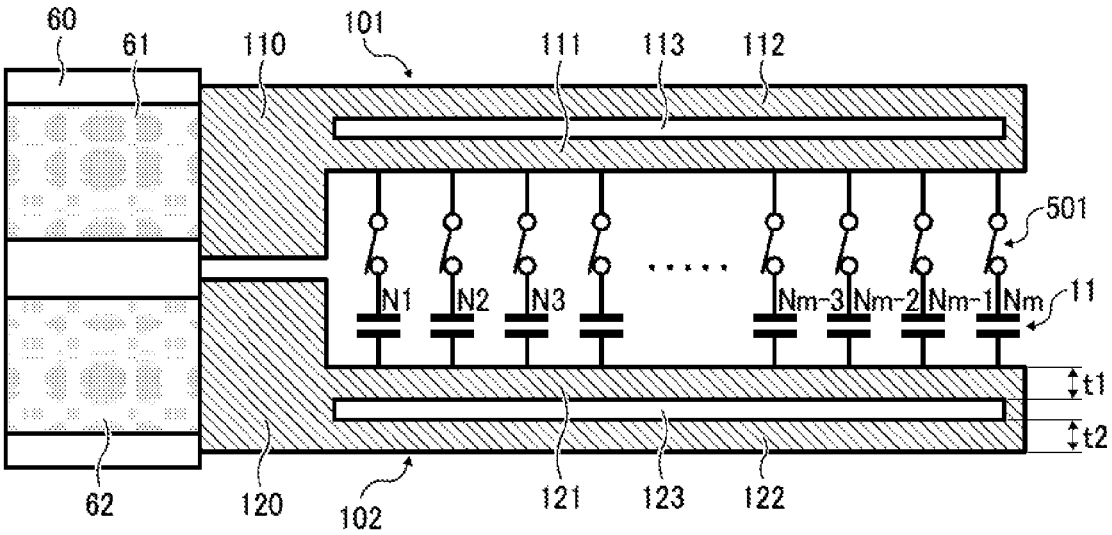
FIG. 4 is an explanatory plan view of a wiring pattern on an actuator substrate according to a first embodiment of the present invention.
Figure 5:
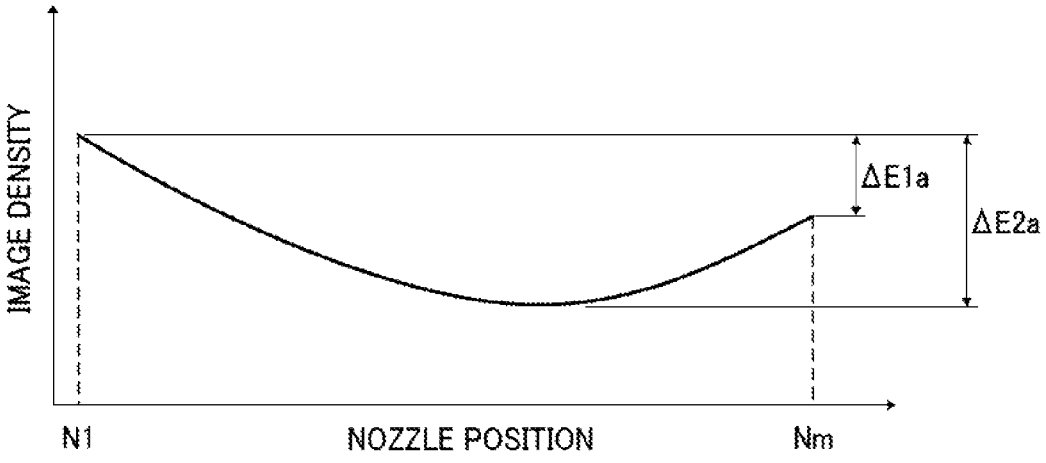
FIG. 5 illustrates a relation between image density and nozzle position.

FIG. 4 is an explanatory plan view of a wiring pattern on the actuator substrate according to a first embodiment of the present invention. FIG. 5 is a view showing an image density at each nozzle position.

In FIG. 4 and in all successive figures, the piezoelectric elements 11 and the switch or the switching element 501 included in the driver IC 500 are defined as equivalents. In the exemplary embodiments, multiple nozzles N1 to Nm are included in one array, and the piezoelectric elements 11 each as a pressure generator corresponding to one of the nozzles N1 to Nm (serving as the nozzles 4), are disposed similarly in the following exemplary embodiments as well.

The actuator substrate 20 includes an individual electrode wiring pattern 101 connected to a wire 61 of the wiring member 60, and a common electrode wiring pattern 102 connected to a wire 62 of the wiring member 60.

The individual electrode wiring pattern 101 is connected to the side of the switches 501, as the plurality of selectors, of the driver IC 500, as the drive circuit, and is disposed along the nozzle alignment direction. The common electrode wiring pattern 102 is connected to the side of the piezoelectric elements 11 as the plurality of pressure generators and is disposed along the nozzle alignment direction.

The individual electrode wiring pattern 101 is connected to the wire 61 of the wiring member 60 at a connection pad 110. The common electrode wiring pattern 102 is connected to the wire 62 of the wiring member 60 at a connection pad 120. The connection pads 110, 120 form the group of connection terminals 18.

Herein, the drive signal is supplied from the controller to the connection pad 110 connecting to the wire 61 of the wiring member 60 of the individual electrode wiring pattern 101 (that is, the drive signal supplying side). At the same time, the drive signal is supplied from the connection pad 120 connecting to the wire 62 of the wiring member 60 of the common electrode wiring pattern 102.

Further, among the multiple nozzles 4 (from the nozzles N1 to Nm), the nozzle 4 nearest to the drive signal supplying side is set as the nozzle N1 and the farthest nozzle 4 is set as the nozzle Nm.

The image forming apparatus includes the controller that includes a drive waveform generator to generate and output a dive signal and a selector to selectively turn on the switch 501 according to image data.

The controller outputs a drive signal between the individual electrode wiring pattern 101 and the common electrode wiring pattern 102 of the actuator substrate 20 via the wiring member 60.

With this structure, via the switch 501 that is turned on by a selection signal, a drive signal is applied to a corresponding piezoelectric element 11, and liquid droplets are discharged from the nozzle 4.

The common electrode wiring pattern 102 includes a first common electrode wiring pattern 121 disposed in a direction of arrangement of the pressure generator, that is, in the nozzle alignment direction. The lower electrode 13 of the plurality of piezoelectric elements 11 is connected to the first common electrode wiring pattern 121.

Herein, the drive signal is supplied from one side of the connection pads 110, 120. Specifically, the drive signal is configured to be supplied from one side in the nozzle alignment direction of the first individual electrode wiring pattern 111 and the first common electrode wiring pattern 121.

Accordingly, the first common electrode wiring pattern 121 includes a side near to the drive signal supply side and a side far from the drive signal supply side in the nozzle alignment direction, using the side to supply the drive signal to the piezoelectric element 11 as a base point.

The nearest side to and the farthest side from the drive signal supply side of the first common electrode wiring pattern 121 are electrically connected via a second common electrode wiring pattern 122 as a second wiring pattern.

With this structure, the common electrode wiring pattern 102 is configured as a loop-shaped pattern.

Herein, the common electrode wiring pattern 102 includes a slit 123 disposed on the actuator substrate 20 over a range where the piezoelectric element 11 is connected along the nozzle alignment direction.

With this structure, the loop-shaped pattern is formed including the first common electrode wiring pattern 121 as the first wiring pattern and the second common electrode wiring pattern 122 as the second wiring pattern, on the same surface of the actuator substrate 20.

Similarly, the individual electrode wiring pattern 101 includes a first individual electrode wiring pattern 111 as a first wiring pattern disposed in the nozzle alignment direction, and a switch 501 serving as a selector to select a piezoelectric element 11 that supplies a drive signal to the first individual electrode wiring pattern 111 is connected to the individual electrode wiring pattern 101. Another terminal of the switch 501 is connected to an upper electrode 14 of the piezoelectric element 11 via the individual wire 16.

Herein, the first individual electrode wiring pattern 111 adopts a structure of one-side supply as described above, so that, in the nozzle alignment direction, there are a near side to the supply side of the drive signal to be supplied to the piezoelectric element 11 and a far side therefrom.

Then, the near side to and the far side from the drive signal supply side of the first individual electrode wiring pattern 111 are electrically connected via the second individual electrode wiring pattern 122 as the second wiring pattern.

With this structure, the individual electrode wiring pattern 101 is configured as a loop-shaped pattern.

Herein, the individual electrode wiring pattern 101 disposed on the actuator substrate 20 includes a slit 113 over a range where the switch 501 connects the individual electrode wiring pattern 101.

With this structure, the loop-shaped pattern is formed including the first individual electrode wiring pattern 111 as the first wiring pattern and the second individual electrode wiring pattern 112 as the second wiring pattern, on the same surface of the actuator substrate 20.

Figure 6:
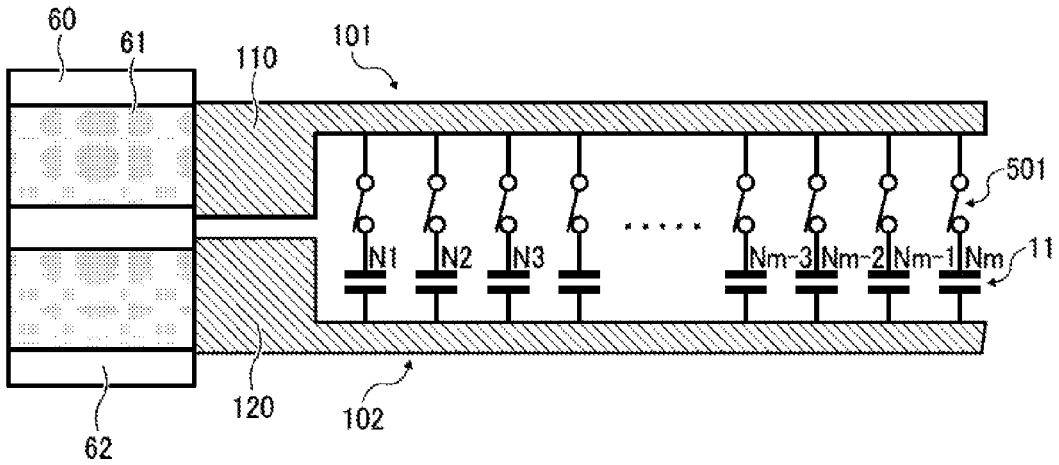
FIG. 6 illustrates a wiring pattern on the actuator substrate according to a modified example.
Figure 7:
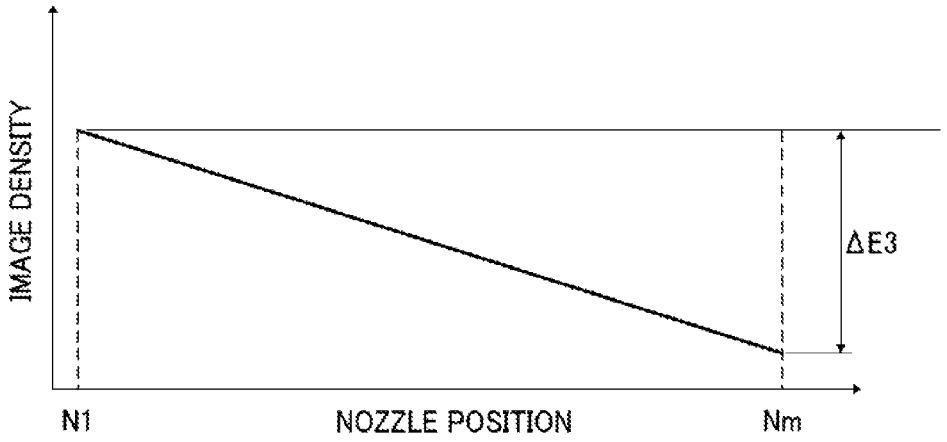
FIG. 7 illustrates a relation between image density and nozzle position.

FIG. 6 illustrates a wiring pattern on the actuator substrate according to a comparative example. FIG. 7 illustrates a relation between image density and nozzle position.

The present comparative example is similar to the first embodiment but the second wiring pattern is excluded. Specifically, the common electrode wiring pattern 102 includes a single pattern disposed in the nozzle alignment direction from the connection pad 120, and similarly, the individual electrode wiring pattern 101 includes a single pattern disposed in the nozzle alignment direction from the connection pad 110.

In the present comparative example, away from the drive signal supply side the voltage drop due to wiring resistance increases and the voltage in the drive signal decreases. Specifically, the piezoelectric element 11 corresponding to the nozzle N1 nearest to the drive signal supply side is given the relatively highest voltage of the drive signal, and the piezoelectric element 11 corresponding to the nozzle Nm farthest from the drive signal supply side is given the relatively lowest voltage of the drive signal.

Because the voltage drop of the drive signal increases away from the drive signal supply side, the droplet speed slows and the droplet impacting position is shifted from the desired position, or the droplet volume is reduced in size and the density of the image decreases below the desired density.

For example, as illustrated in FIG. 7, an image density difference ΔE3 is generated between the image density in the nozzle N1 position nearest to the drive signal supply side and that in the nozzle Nm position farthest from the drive signal supply side.

Thus, the image quality decreases not only due to variations in the image density within one head, but due to a rapid change in the image density at a linking portion of the heads when a line-type head is formed by linking a plurality of heads.

By contrast, the liquid discharge head according to the present embodiment is configured such that both ends (a side nearest to and an opposite side farthest from the drive signal supply side) are electrically connected by the second common electrode wiring pattern 122.

With this structure, the drive signal is supplied via the first common electrode wiring pattern 121 and the second common electrode wiring pattern 122. As a result, the drive signal is supplied to the piezoelectric element 11 farthest from the drive signal supply side via the second common electrode wiring pattern 122 from the connection pad 120.

Accordingly, the first common electrode wiring pattern 121 is subject to wiring resistance away from the drive signal supply side, if seen from the drive signal supply side. However, because the drive signal is supplied to the portion farthest from the drive signal supply side of the first common electrode wiring pattern 121 via the second common electrode wiring pattern 122, effect of the wiring resistance can be reduced.

With this structure, as illustrated in FIG. 5, the image density decreases away from the position of the nozzle N1 nearest to the drive signal supply side. However, decrease in the image density changes at a position of the nozzle where the image density difference from the image density of the Nozzle N1 becomes ΔE2a and lessens as nearer to the nozzle Nm farthest from the drive signal supply side and away from the drive signal supply side.

In this case, a potential difference corresponding to the wiring resistance of the second common electrode wiring pattern 122 is generated between the nozzle N1 nearest to the drive signal supply side and the nozzle Nm farthest from the drive signal supply side.

Accordingly, the image density difference ΔE1a which is smaller than the image density difference ΔE2a is generated between the image density at a position of nozzle N1 of the drive signal supply side and the image density at the farthest nozzle Nm from the drive signal supply side (ΔE1a<ΔE2a).

Accordingly, variations in the image density difference at nozzle positions at both ends of the nozzle array can be reduced, and variations in the image density difference at a connection portion when a plurality of heads is connected can be reduced as well.

In the present embodiment, as illustrated in FIG. 4, a width t1 of the first common electrode wiring pattern 121 (that is, a width in a direction perpendicular to the nozzle alignment direction) and a width t2 of the second common electrode wiring pattern 122 are substantially equal. Similarly, the width of the first individual electrode wiring pattern 111 and that of the second individual electrode wiring pattern 122 are substantially the same.

With this configuration, the first common electrode wiring pattern 121 and the second common electrode wiring pattern 122 are balanced in terms of resistance, so that the image density difference between the nozzles at both ends, that is, ΔE1 in FIG. 5 can be reduced in the limited wiring area.

Figure 8:
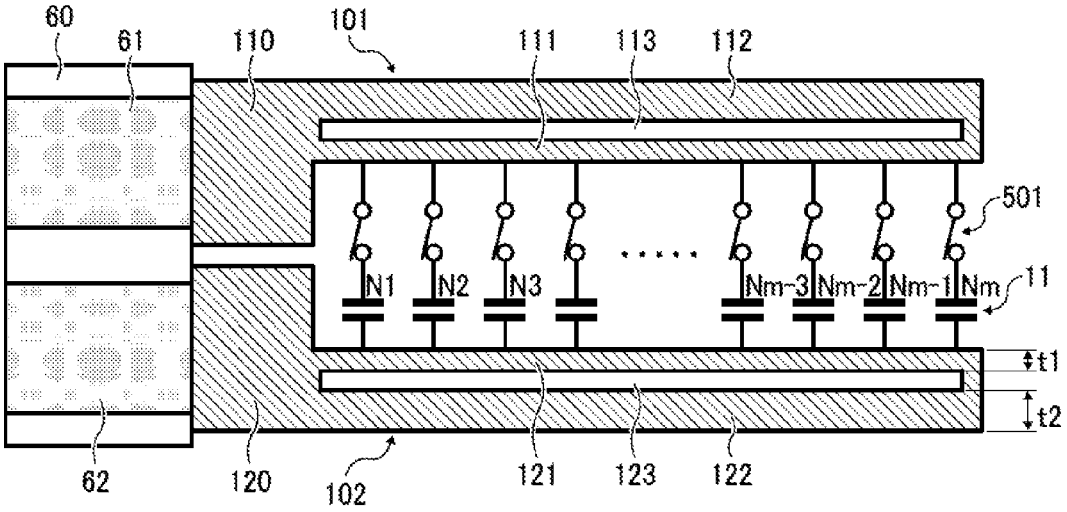
FIG. 8 illustrates a wiring pattern on the actuator substrate according to a second embodiment of the present invention.
Figure 9:
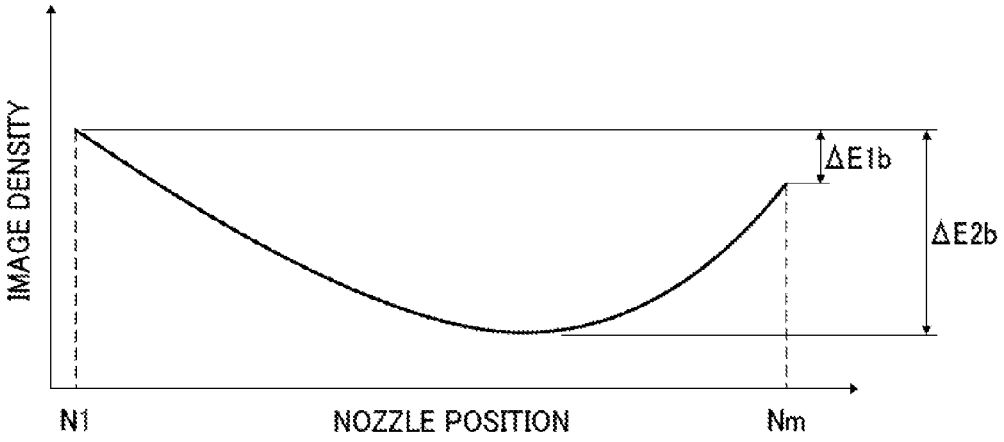
FIG. 9 illustrates a relation between image density and nozzle position.

FIG. 8 is an explanatory plan view of a wiring pattern on the actuator substrate according to a second embodiment of the present invention. FIG. 9 is a view showing an image density at each nozzle position.

In the present embodiment, the width t2 of the second common electrode wiring pattern 122 is wider than the width t1 of the first common electrode wiring pattern 121 (t1<t2). Similarly, the width of the second individual electrode wiring pattern 112 is wider than that of the first individual electrode wiring pattern 111.

With this configuration, as illustrated in FIG. 9, variations of the maximum image density in the nozzle array, that is, the image density difference ΔE2b is greater than the image density difference ΔE2a in the first embodiment of the present invention. However, the image density difference ΔE1b at nozzle positions at both ends is smaller than the image density difference ΔE1a according to the first embodiment (ΔE1b<ΔE1a).

Accordingly, when a plurality of heads is connected, the change in the image density at a connection portion can be further reduced.

Figure 10:
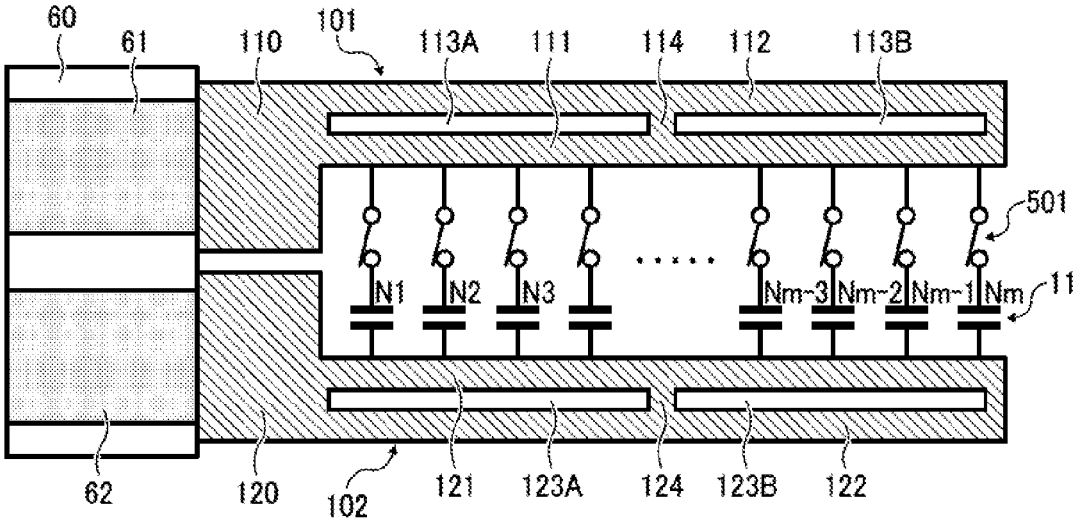
FIG. 10 illustrates a wiring pattern on the actuator substrate according to a third embodiment of the present invention.
Figure 11:
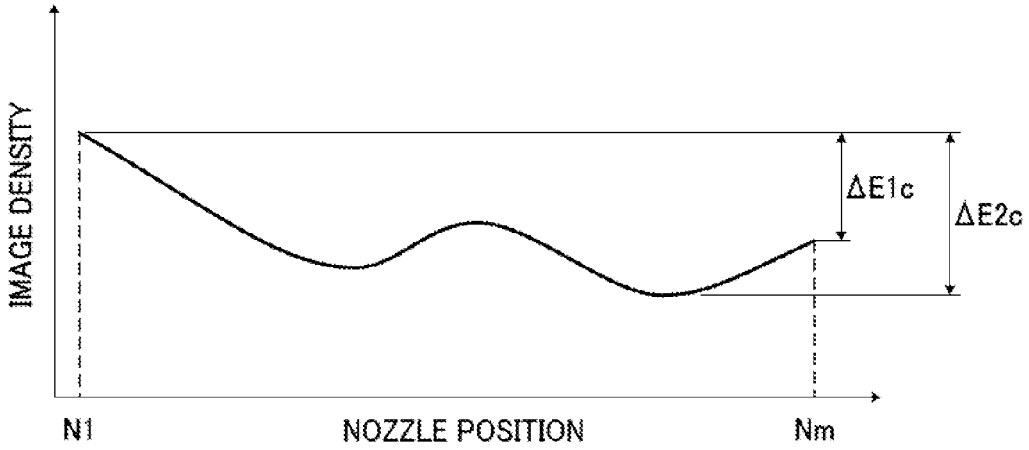
FIG. 11 illustrates a relation between image density and nozzle position.

FIG. 10 is an explanatory plan view of a wiring pattern on the actuator substrate according to a third embodiment of the present invention. FIG. 11 is a view showing an image density at each nozzle position.

In the present third embodiment, the common electrode wiring pattern 102 includes a cross-linked wiring pattern 124 to connect the second common electrode wiring pattern 122 to the first common electrode wiring pattern 121 at a portion between the side nearer to the drive signal supply side and the farther side from the drive signal supply side of the first common electrode wiring pattern 121 in the nozzle alignment direction.

With this structure, in the present third embodiment, two loop-like patterns sharing the cross-linked wiring pattern 124 are generated, in which the side near to and the side far from the drive signal supply side of the first common electrode wiring pattern 121 in the nozzle alignment direction are electrically connected via the second common electrode wiring pattern 122.

Similarly, the individual electrode wiring pattern 101 includes a cross-linked wiring pattern 114 to connect the second individual electrode wiring pattern 112 with the first individual electrode wiring pattern 111 between the side nearer to the drive signal supply side and the farther from the drive signal supply side of the first individual electrode wiring pattern 111 in the nozzle alignment direction.

With this structure, in the present third embodiment, two loop-like patterns sharing the cross-linked wiring pattern 114 are generated, in which, in the nozzle alignment direction, the side near to and the side far from the drive signal supply side of the first individual electrode wiring pattern 111 are electrically connected via the second individual electrode wiring pattern 112.

Herein, the common electrode wiring pattern 102 includes two slits 123A, 123B along the nozzle alignment direction, to thus form the cross-linked wiring pattern 124. In addition, the individual electrode wiring pattern 101 includes two slits 113A, 113B along the nozzle alignment direction, to thus form a cross-linked wiring pattern 114.

Configured as above, a drive signal is supplied to the piezoelectric element 11 corresponding to the nozzle position in the middle of the nozzle alignment direction via the cross-linked wiring pattern 124 from the second common electrode wiring pattern 122.

With this configuration, as illustrated in FIG. 11, image density around the center in the nozzle alignment direction, where the image density is typically decreased, is improved. Specifically, the image density difference ΔE1c at both end nozzle positions is greater than the image density difference ΔE1a according to the first embodiment (ΔE1c>E1a); however, the maximum image density difference ΔE2c of the image density in the nozzle array is smaller than the image density difference ΔE2a according to the first embodiment (ΔE2c<ΔE2a).

Figure 12:
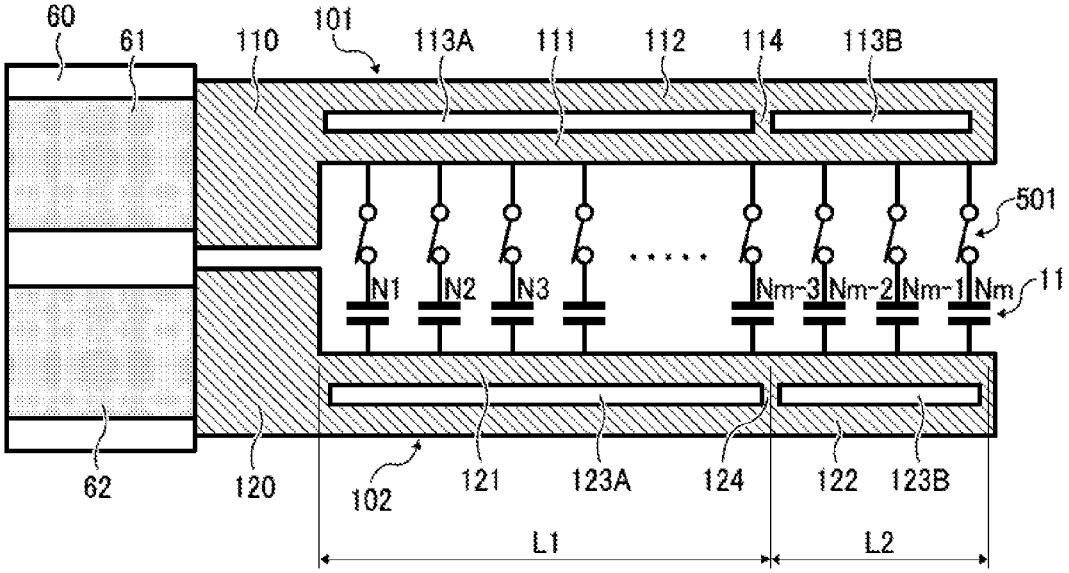
FIG. 12 is an explanatory plan view of a wiring pattern on the actuator substrate according to a fourth embodiment of the present invention.
Figure 13:
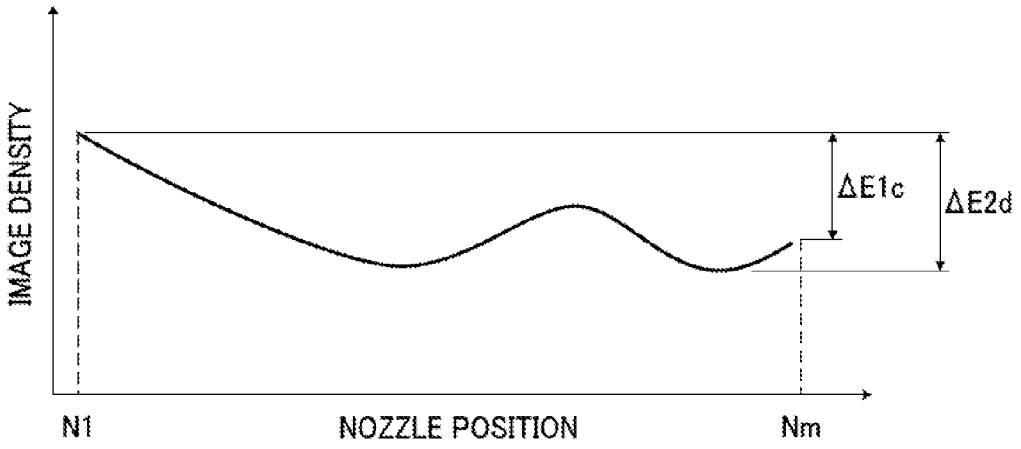
FIG. 13 is a view showing an image density at each nozzle position.

FIG. 12 is an explanatory plan view of a wiring pattern on the actuator substrate according to a fourth embodiment of the present invention. FIG. 13 is a view showing an image density at each nozzle position.

In the present fourth embodiment, the cross-linked wiring pattern 124 of the common electrode wiring pattern 102 is arranged at a side farther from the drive signal supply side. In this case, the cross-linked wiring pattern 124 is disposed purposely at a distance L1 from the nearest side to the drive signal supply side and at a distance L2 from the farthest side, and the distance L1 is greater than the distance L2.

Specifically, the cross-linked wiring pattern 124 as a boundary of at least two loop-like patterns is disposed at a farther side from the drive signal supply side than the mid-position between the position nearest to the drive signal supply side and the position farthest from the drive signal supply side.

The cross-linked wiring pattern 114 of the individual electrode wiring pattern 101 is also similarly positioned.

As configured as above, the nozzle position at which the image density lowers maximally becomes a farther side from the drive signal supply side than the center position of the nozzle array, so that the image density of the area where the image density is most lowered is improved.

With this structure, compared to the third embodiment, the maximum image density difference ΔE2d in the nozzle array can be reduced (ΔE2d<ΔE2c).

Figure 14:
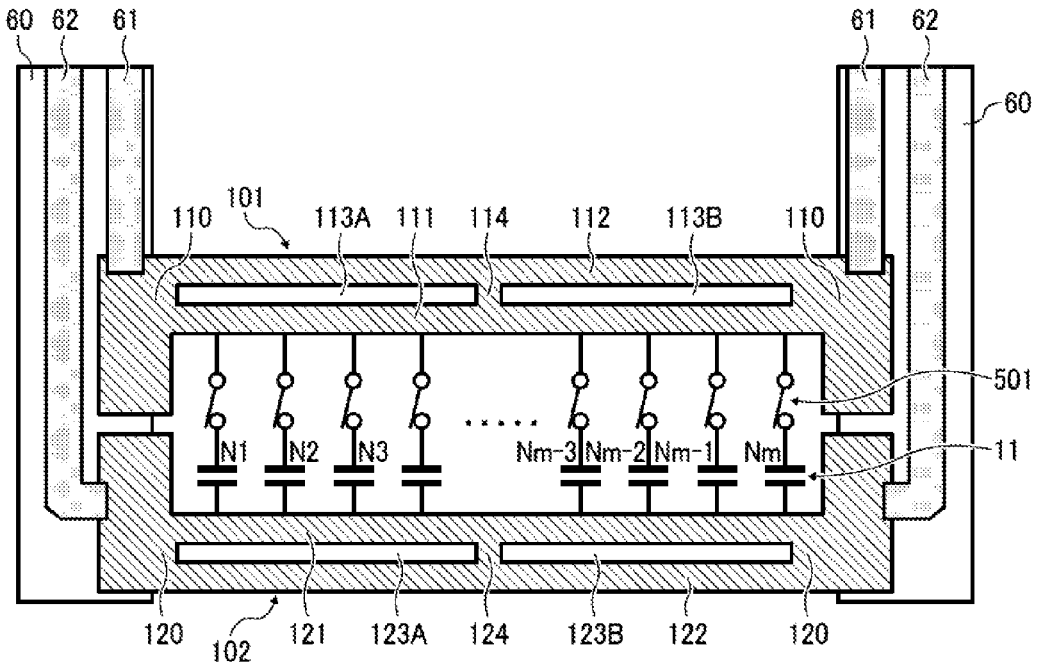
FIG. 14 is an explanatory plan view of a wiring pattern on the actuator substrate according to a fifth embodiment of the present invention.
Figure 15:
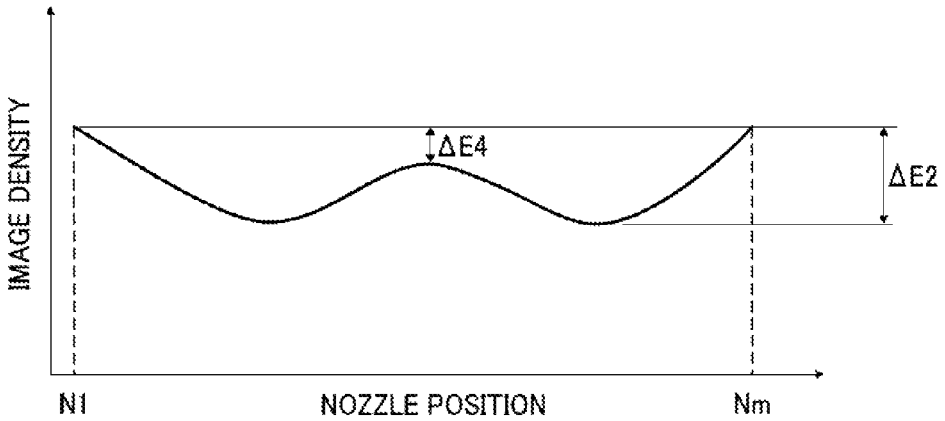
FIG. 15 is a view showing an image density at each nozzle position.

FIG. 14 is an explanatory plan view of a wiring pattern on the actuator substrate according to a fifth embodiment of the present invention. FIG. 15 is a view showing an image density at each nozzle position.

The present embodiment is configured such that, in the structure of the third embodiment, the drive signal is supplied from both sides of the first common electrode wiring pattern 121 and the first individual electrode wiring pattern 111.

In this case, the common electrode wiring pattern 102 is configured such that the second common electrode wiring pattern 122 is electrically connected to both ends of the first common electrode wiring pattern 121. Herein, because the cross-linked wiring pattern 124 is disposed, both ends and the center portion of the first common electrode wiring pattern 121 are connected via the second common electrode wiring pattern 122.

Specifically, each end in the nozzle alignment direction of the first common electrode wiring pattern 121 is connected to the drive signal supply side, both ends of the first common electrode wiring pattern 121 are electrically connected via the second common electrode wiring pattern 122, and the cross-linked wiring pattern 124 electrically connects the first common electrode wiring pattern 121 to the second common electrode wiring pattern 122 intermediate between both ends of the first common electrode wiring pattern 121.

The individual electrode wiring pattern 101 is also similarly configured.

If configured as above, as illustrated in FIG. 15, because the piezoelectric element 11 in the center of the nozzle array is connected to the drive signal supply side via the cross-linked wiring pattern 124 and the second common electrode wiring pattern 122, the image density difference ΔE4 in the center position of the nozzle array lessens compared to the image density difference ΔE2 at the nozzle positions between the center and both ends.

With this structure, variations in the image density between both ends and the center can be reduced even in the case of supplying the drive signal from both sides.

Figure 16:
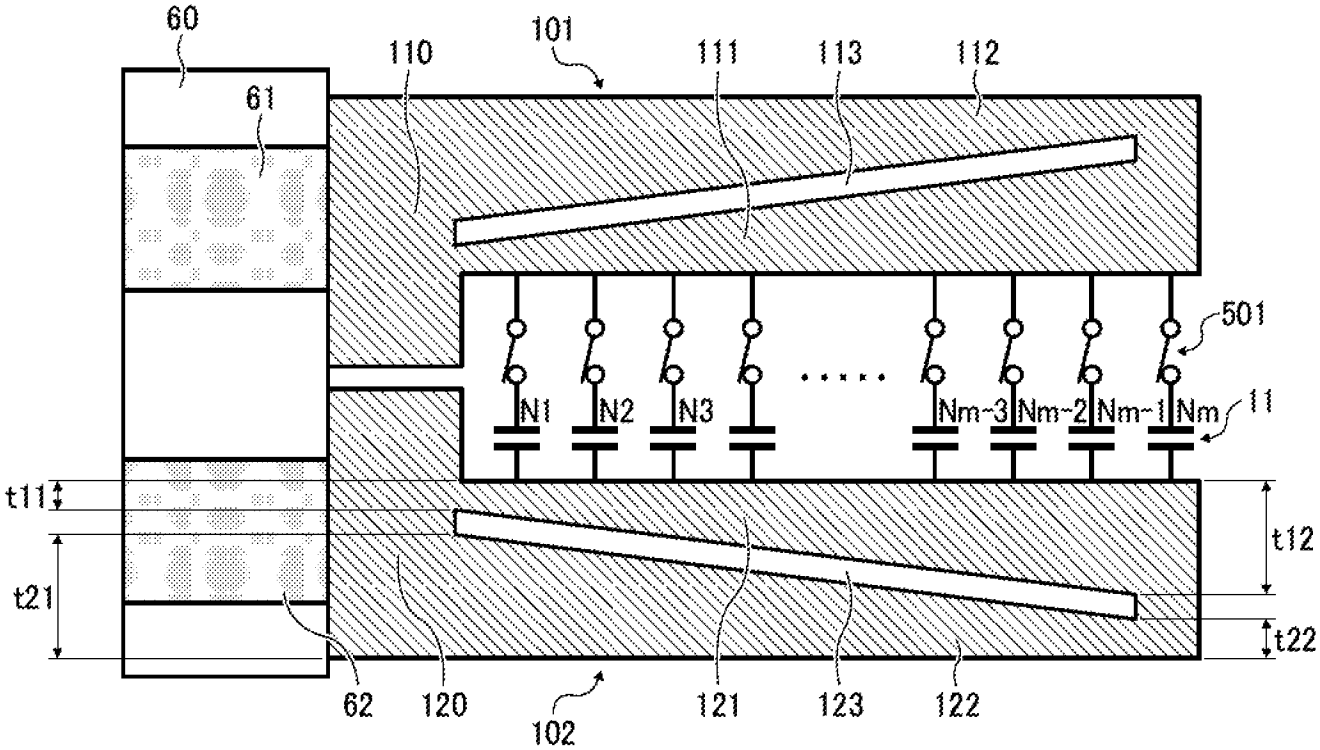
FIG. 16 is an explanatory plan view of a wiring pattern on the actuator substrate according to a sixth embodiment of the present invention.
Figure 17:
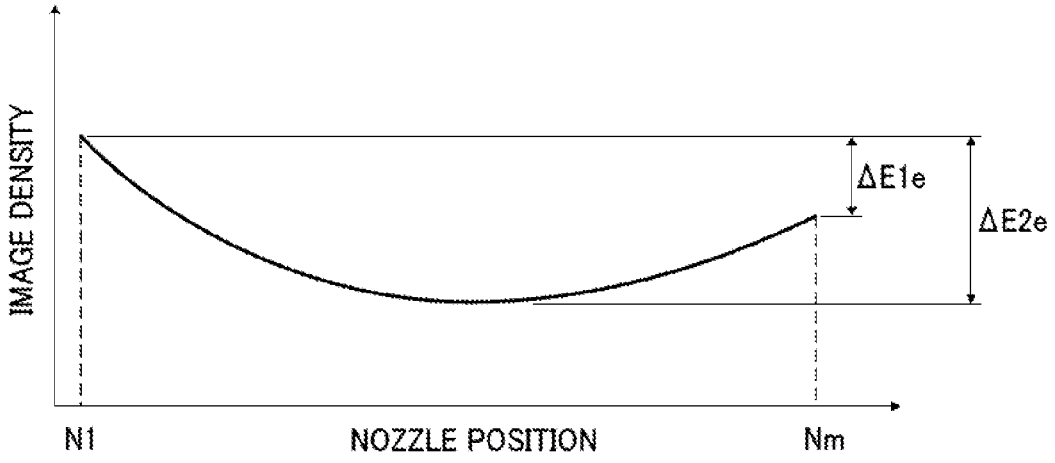
FIG. 17 is a view showing an image density at each nozzle position.

FIG. 16 is an explanatory plan view of a wiring pattern on the actuator substrate according to a sixth embodiment of the present invention. FIG. 17 is a view showing an image density at each nozzle position.

In the present sixth embodiment, the width of the first common electrode wiring pattern 121 gradually widens from the side near to the drive signal supply side toward the side farther from the drive signal supply side. The second common electrode wiring pattern 122 gradually narrows from the side near to the drive signal supply side toward the side farther from the drive signal supply side.

In the present sixth embodiment, the width of the first common electrode wiring pattern 121 gradually widens from the width t11 of the side nearest to the drive signal supply side to the width t12 of the side farthest from the drive signal supply side (t11<t12). The second common electrode wiring pattern 122 gradually narrows from the width t21 of the side nearest to the drive signal supply side to the width t22 of the side farthest from the drive signal supply side (t22<t21). Similarly, the width of the first individual electrode wiring pattern 111 and that of the second individual electrode wiring pattern 112 stand the same relation as that between the first common electrode wiring pattern 121 and the second common electrode wiring pattern 122.

With this configuration, as illustrated in FIG. 17, the reduced image density difference ΔE1e at the nozzle position at the end in the nozzle alignment direction is obtained, so that the variations in the density can be reduced. Further, the maximum image density difference ΔE2e of the image density in the nozzle row is generated, but the density gradient around the nozzle row center portion can be relatively small.

Figure 18:
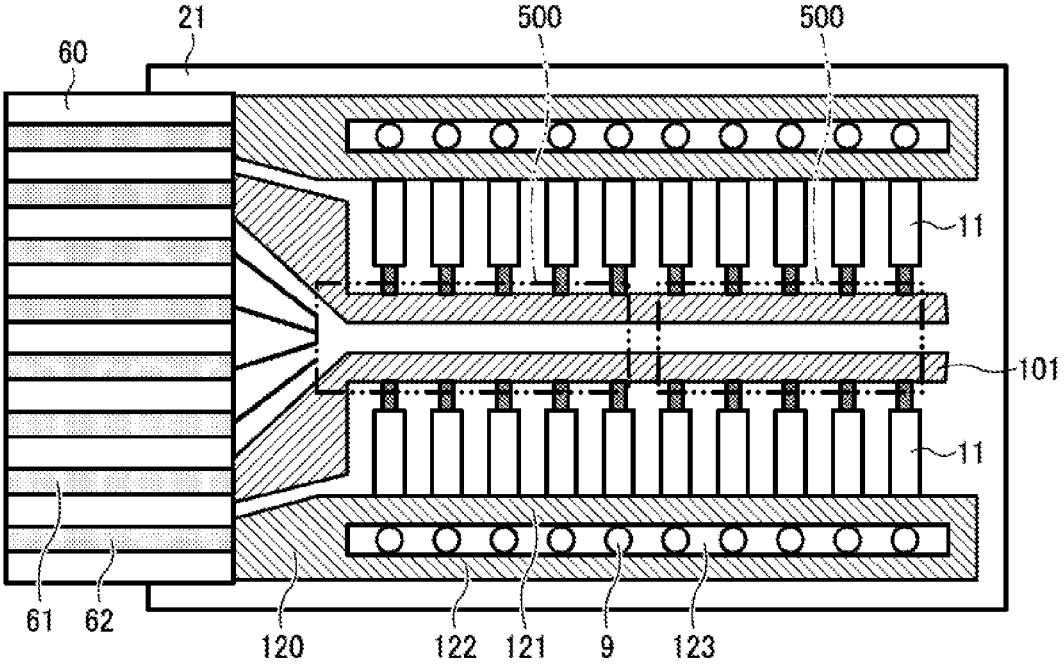
FIG. 18 illustrates a wiring pattern on the actuator substrate according to a seventh embodiment of the present invention.

FIG. 18 illustrates a wiring pattern on the actuator substrate according to a seventh embodiment of the present invention.

In the present seventh embodiment, supply ports 9 are formed in the slit 123 between the first common electrode wiring pattern 121 and the second common electrode wiring pattern 122 of the common electrode wiring pattern 102 that is formed in the actuator substrate 20.

In addition, in the present embodiment, the individual electrode wiring pattern 101 is formed of a single pattern.

The supply ports 9 are disposed in the slit 123, so that the space may be effectively used, the head can be compact, and the manufacturing cost can be lowered.

Figure 19:
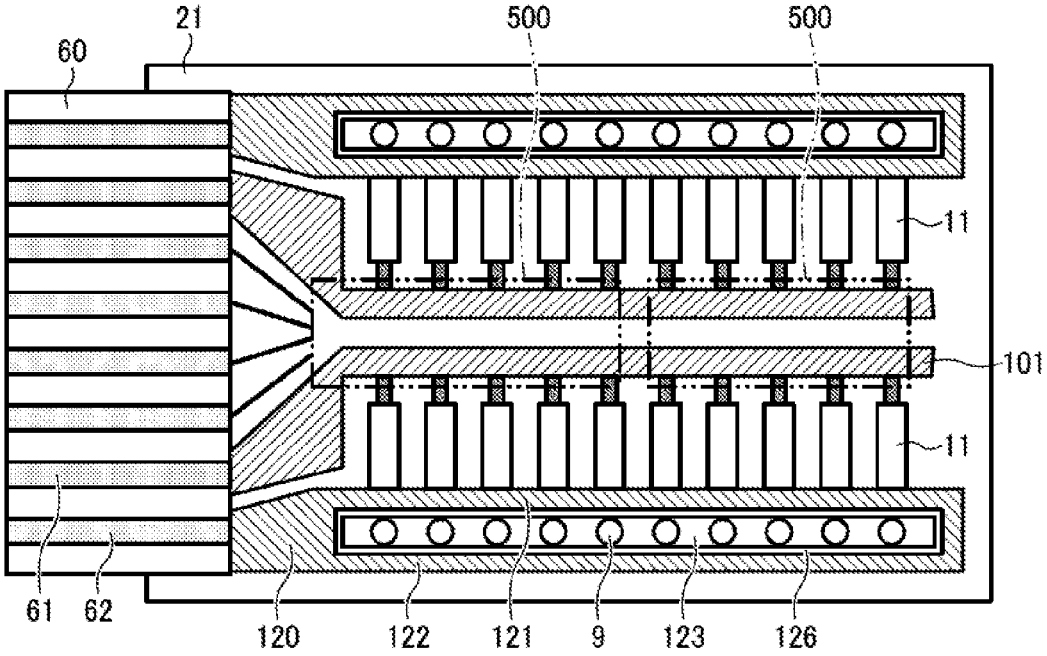
FIG. 19 illustrates a wiring pattern on the actuator substrate according to an eighth embodiment of the present invention.

FIG. 19 illustrates a wiring pattern on the actuator substrate according to an eighth embodiment of the present invention.

In the present eighth embodiment, a guard ring 126 to prevent the wiring pattern from contacting the liquid is formed on an internal wall of the loop-like pattern formed by the circumference portion of the slit 123, that is, the first common electrode wiring pattern 121 and the second common electrode wiring pattern 122.

With this structure, even though the liquid leaks from the supply ports 9, the liquid does not contact either the first common electrode wiring pattern 121 or the second common electrode wiring pattern 122.

In each of the above embodiments, an example in which both of the individual electrode wiring pattern 101 and the common electrode wiring pattern 102 include the first wiring pattern and the second wiring pattern, and an example in which the common electrode wiring pattern 102 alone includes the first wiring pattern and the second wiring pattern are described. Alternatively, however, a structure in which the individual electrode wiring pattern alone includes the first wiring pattern and the second wiring pattern may be employed.

When both of the individual electrode wiring pattern 101 and the common electrode wiring pattern 102 include the first wiring pattern and the second wiring pattern, a width of the pattern and a shape of the slit may be different from the one formed in the individual electrode wiring 101 side and the other formed in the common electrode wiring 102 side.

In addition, each of the above embodiments is configured such that the drive waveform generator generates and outputs a drive signal to the individual electrode wiring 101 side, the electrical current of the drive signal flows to the individual electrode wiring 101 side, and the electrical current of the drive signal is returned from the common electrode wiring 102 side; alternatively, however, the flow of the current may be reversed. Specifically, the electrical current of the drive signal can be configured to flow into the common electrode wiring 102 side, and the electrical current of the drive signal may be returned from the individual electrode wiring 101 side.

In addition, although in each of the above embodiments, the second wiring pattern is linearly formed, alternatively the second wiring pattern may be curved.

In addition, in the above embodiments, a thin film piezoelectric element is used; however, the present embodiment can be applied to a piezoelectric head employing a layered piezoelectric element as a pressure generator, and otherwise, to a thermal head employing an electrothermal transducer element as a pressure generator.

In each of the embodiments, description is given in a state in which the first wiring pattern and the second wiring pattern are formed on the same surface in the depth direction of the actuator substrate; however, the first wiring pattern and the second wiring pattern may be formed on the different surface in the depth direction of the actuator substrate. In this case, the contact hole connecting the second wiring pattern to the first wiring pattern forms part of the second wiring pattern.

A ninth embodiment according to the present invention will be described with reference to FIGS. 20 through 22.

Figure 20:
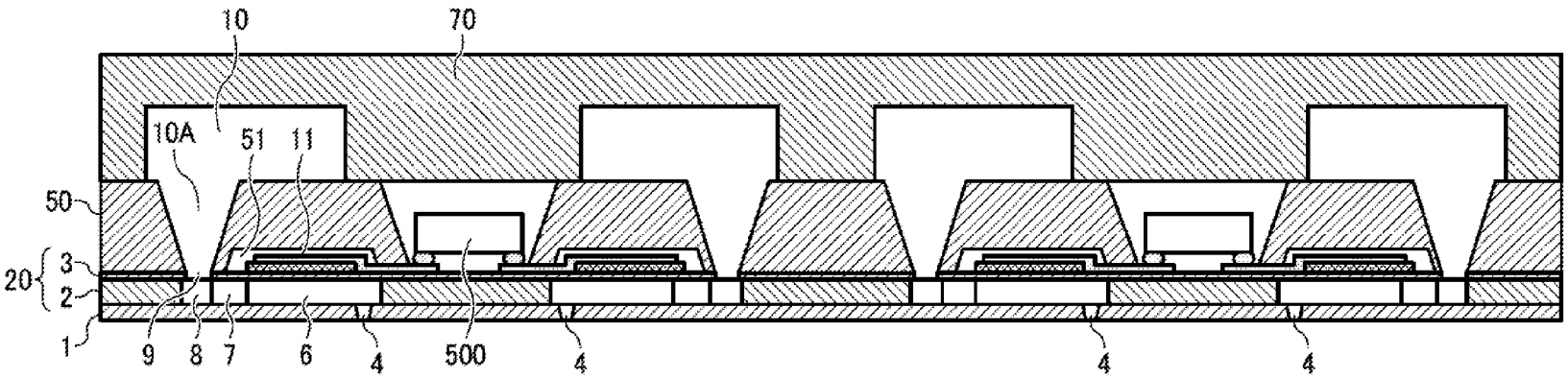
FIG. 20 illustrates a cross-sectional view of the liquid discharge head along the direction perpendicular to the nozzle alignment direction according to a ninth embodiment of the present invention.

FIG. 20 illustrates a cross-sectional view of the liquid discharge head along the direction perpendicular to the nozzle alignment direction according to the ninth embodiment of the present invention; FIG. 21 illustrates an enlarged cross-sectional view of the liquid discharge head of FIG. 20 showing principal part thereof along the direction perpendicular to the nozzle alignment direction; and FIG. 22 illustrates a cross-sectional view of the liquid discharge head of FIG. 20 showing principal part thereof along the nozzle alignment direction.

The liquid discharge head includes, similarly to the aforementioned liquid discharge head, a nozzle plate 1, a channel plate 2, a diaphragm 3, a piezoelectric element 11 as a pressure generator, a retainer substrate 50, and a frame 70 serving also as a common liquid chamber.

In the present embodiment as well, the channel plate 2, the diaphragm 3, and the piezoelectric element 11 form an actuator substrate 20. However, the thus-formed actuator substrate 20 if completed as an independent member does not include further addition of the nozzle plate 1, retainer substrate 50, frame 70, and the like.

A plurality of nozzles 4 that discharges liquid droplets is disposed on the nozzle plate 1. Herein, four nozzles arrays each including a plurality of nozzles 4 are disposed.

The channel plate 2 together with the nozzle plate 1 and the diaphragm 3 form an individual liquid chamber 6 that each nozzle 4 communicates with, a fluid resistor 7 that communicates with the individual liquid chamber 6, and a liquid inlet 8 that the fluid resistor 7 communicates with.

The liquid inlet 8 communicates with a common liquid chamber 10 formed by the frame 70, via a supply port 9 of the diaphragm 3 and an orifice manifold 10A, part of the common liquid chamber of the retainer substrate 50.

The diaphragm 3 forms a deformable vibrating area 30 as part of the wall of the individual liquid chamber 6. The piezoelectric element 11 is disposed integrally with the vibrating area 30 on a surface opposite the individual liquid chamber 6 of the vibration area 30 of the diaphragm 3, so that the vibration area 30 and the piezoelectric element 11 form a piezoelectric actuator.

The piezoelectric element 11 is constructed of, from a side of the vibration area 30, a lower electrode 13, a piezoelectric layer 12, and an upper electrode 14 sequentially laminated in this order. An insulation film 21 is formed on the piezoelectric element 11.

The lower electrode 13 serving as a common electrode for the plurality of piezoelectric elements 11 is connected to the first common electrode wiring pattern 121 of the common electrode wiring pattern 102 via a common wire 15.

Figure 22:
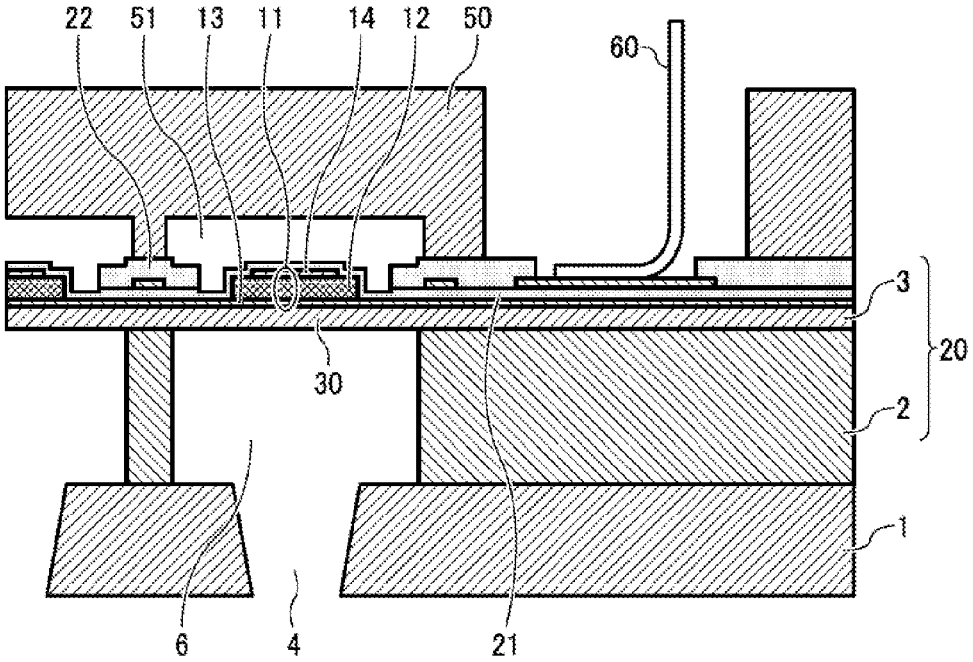
FIG. 22 illustrates a cross-sectional view of the liquid discharge head of FIG. 20 showing main part thereof along the nozzle alignment direction.

Herein, as illustrated in FIG. 22, the lower electrode 13 is a single electrode layer disposed to cover all the piezoelectric element 11 in the nozzle alignment direction, and therefore, connects the first common electrode wiring pattern 121 and at least all over the arrangement area of the plurality of piezoelectric elements 11.

Figure 21:
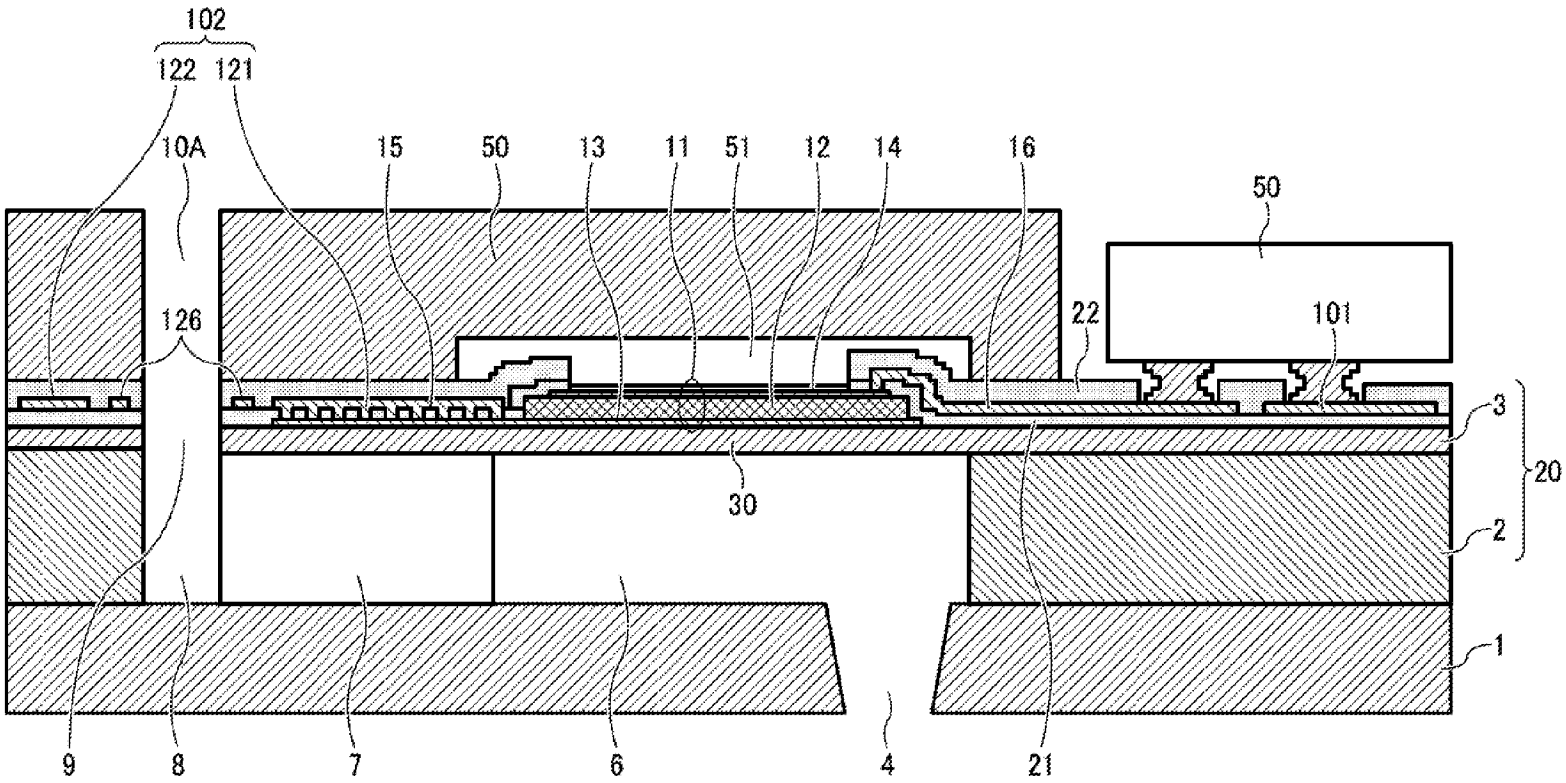
FIG. 21 illustrates an enlarged cross-sectional view of the liquid discharge head of FIG. 20 showing main part thereof along the direction perpendicular to the nozzle alignment direction.

In addition, as illustrated in FIG. 21, the first common electrode wiring pattern 121 of the common electrode wiring pattern 102 is configured such that the second common electrode wiring pattern 122 is electrically connected to both ends of the first common electrode wiring pattern 121.

Also, as illustrated in FIG. 21, a supply port 9 communicating with the common liquid chamber 10 is disposed between the first common electrode wiring pattern 121 and the second common electrode wiring pattern 122 of the common electrode wiring pattern 102. A guard ring 126 to prevent the liquid from moving to the pattern side is disposed between the supply port 9 and the first common electrode wiring pattern 121 and between the supply port 9 and the second common electrode wiring pattern 122.

The upper electrode 14 as an individual electrode of the piezoelectric element 11 is connected to a driver IC 500 via the individual wire 16. The individual wire 16 is covered by an insulating film 22.

The driver IC 500 is so mounted on the actuator substrate 20 as to cover an area between rows of piezoelectric elements 11 using any method of flip chip bonding or wire bonding.

The driver IC 500 mounted to the actuator substrate 20 is connected to the individual electrode wiring pattern 101 to which the drive waveform or the drive signal is supplied.

Wires provided to the wiring member 60 electrically connects the driver IC 500, the individual electrode wiring pattern 101, and the common electrode wiring pattern 102, and the other end of the wiring member 60 connects to a controller.

The retainer substrate 50 that forms a concave vibration chamber 51 accommodating the piezoelectric element 11 is disposed on the actuator substrate 20.

The retainer substrate 50 also forms part of the common liquid chamber 10 or the orifice manifold 10A. The retainer substrate 50 is bonded to a side of the diaphragm 3 of the actuator substrate 20 with an adhesive.

The thus-formed liquid discharge head includes the liquid discharge head as described with reference to FIG. 1 or others, and a detailed description thereof will be omitted.

In the present ninth embodiment, because the first common electrode wiring pattern of the common electrode wiring pattern is electrically connected via both ends thereof with the second common electrode wiring pattern, the same effect and performance as described above may be obtained. With this configuration as well, the same effect as that of the seventh and eighth embodiments described above can be obtained.

Figure 23:
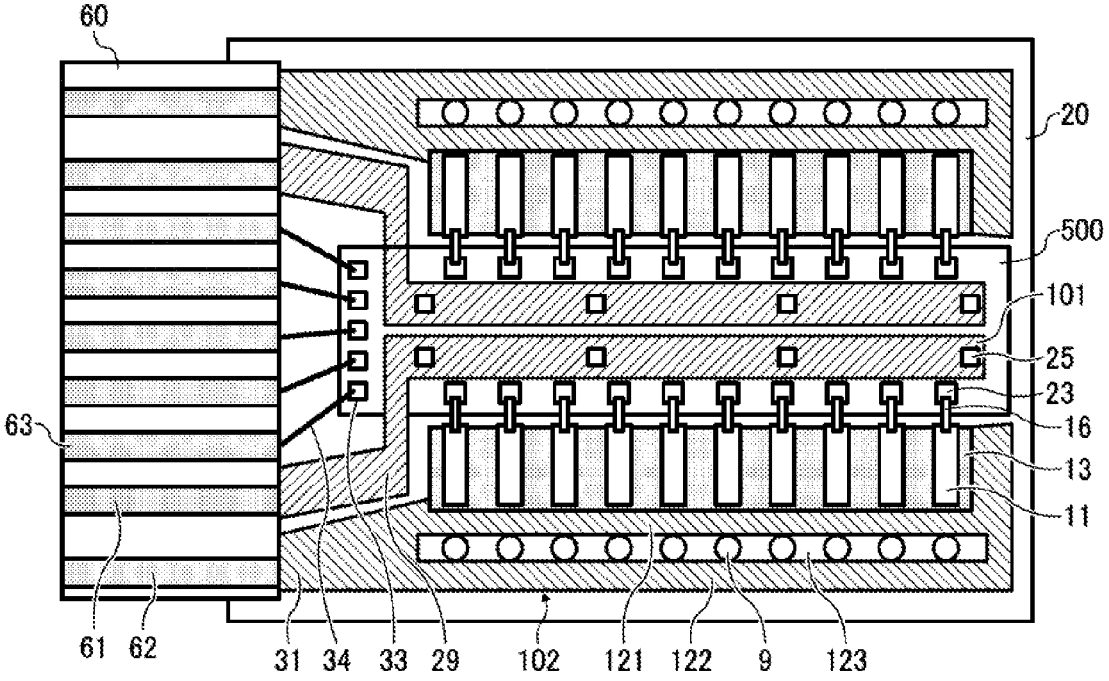
FIG. 23 illustrates a wiring pattern on the actuator substrate according to a tenth embodiment of the present invention.
Figure 24:
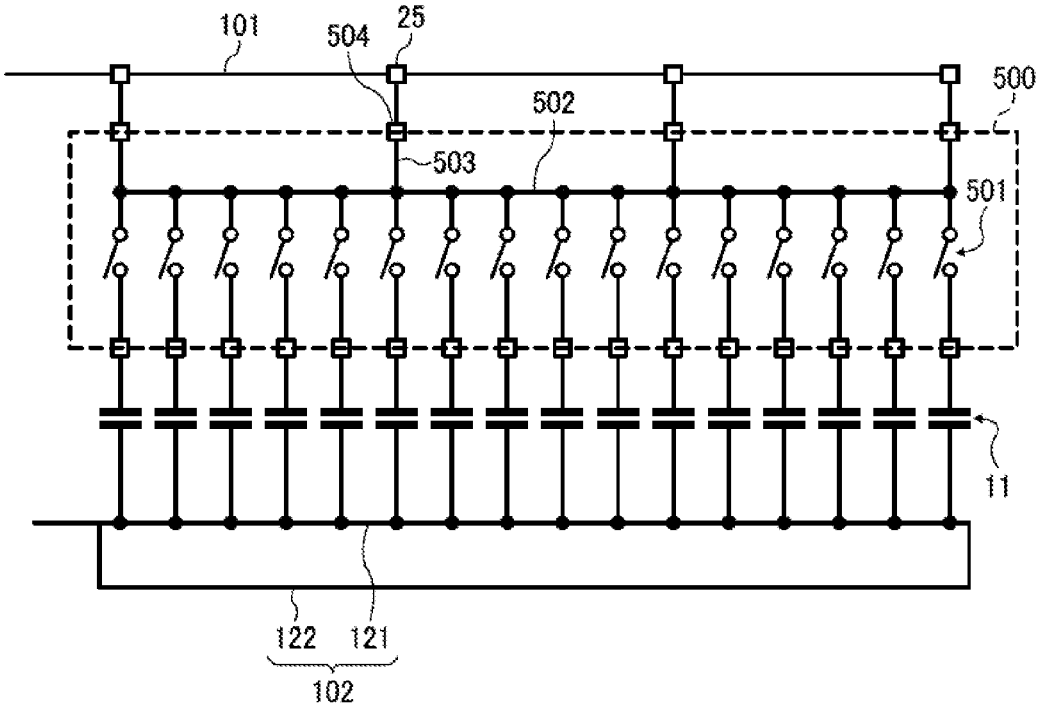
FIG. 24 illustrates an equivalent circuit according to the tenth embodiment.

FIG. 23 illustrates a wiring pattern on the actuator substrate according to a tenth embodiment of the present invention; and FIG. 24 illustrates an equivalent circuit according to the tenth embodiment.

The piezoelectric elements 11 each as a pressure generator are disposed on the actuator substrate 20 along the nozzle alignment direction.

The upper electrode 14 as an individual electrode of the piezoelectric element 11 is electrically connected to a drive power output terminal 23 on the actuator substrate 20 via the individual wire 16. The drive power output terminal 23 is a terminal to output the drive power or the drive signal from the driver IC 500 to the piezoelectric element 11.

The individual electrode wiring pattern 101 is disposed along the row of the drive power output terminal 23 on the actuator substrate 20 in the vicinity of the drive power output terminal 23 on the actuator substrate 20.

Drive power input terminals 25 disposed on the actuator substrate 20 are electrically connected to the individual electrode wiring pattern 101 at predetermined positions. The drive power input terminal 25 is a terminal to input the drive power or the drive signal into the driver IC 500.

Specifically, as illustrated in FIG. 24 with the equivalent circuit, the plurality of selectors, that is, each of the switches 501, is connected to every other inside the driver IC 500 via an internal wire 502. In addition, the internal wire 502 includes lead-out wires 503, fewer in number than the switches 501. A drive power input terminal 504 to the side of the driver IC 500 is disposed to the lead-out wire 503, and the drive power input terminal 504 and the drive power input terminal 25 on the individual electrode wiring pattern 101 are connected to each other.

The driver IC 500 is so mounted as to cover the drive power output terminal 23 and the individual electrode wiring pattern 101 on the actuator substrate 20.

The drive power input terminal 25 of the driver IC 500 and the drive power input terminal 25 on the actuator substrate 20 overlap, thereby achieving an electrical connection, and the drive power output terminal of the driver IC 500 itself and the drive power output terminal 23 on the actuator substrate 20 overlap, thereby achieving an electrical connection.

Other wiring drawn in the internal device of the driver IC 500 from the drive power input terminal 25 is connected to switching elements, the number of which is equal to or greater than that of the drive power output terminal 23, and is electrically connected to the drive power output terminal 23 via at least one switching element.

The individual electrode wiring pattern 101 is disposed at least in an area from the drive power output terminal 23 disposed at one end of the actuator substrate 20 to the drive power output terminal 23 disposed at the other end of the actuator substrate 20, in the nozzle alignment direction.

The one end of the individual electrode wiring pattern 101 (that is, the leftmost side in FIG. 23) is connected to the wire 61 of the wiring member 60 via a first lead-out wire 29.

The individual electrode wiring pattern 101 and the first lead-out wire 29 can be formed of a foil of metal such as aluminum, gold, copper, nickel, and the like, subjected to patterning simultaneously. Alternatively, metal foils patterned separately in different processes can be electrically connected to each other.

The lower electrode 13 being a common electrode of the piezoelectric element 11 is an electrode common to the plurality of piezoelectric elements 11 disposed in one row. The first common electrode wiring pattern 121 of the common electrode wiring pattern 102 is disposed along the lower electrode 13 in the nozzle alignment direction, so as not to overlap the piezoelectric elements 11 from right to left end of the piezoelectric elements 11 aligned in one row.

The first common electrode wiring pattern 121 of the common electrode wiring pattern 102 and the lower electrode 13 are electrically connected for each of the piezoelectric elements 11 aligned in the same row.

The first common electrode wiring pattern 121 includes a side near to the drive signal supply side and another side far from the drive signal supply side in the nozzle alignment direction. The common electrode wiring pattern 102 includes the second common electrode wiring pattern 122 that electrically connects the near side to the drive signal supply side of the first common electrode wiring pattern 121 with the far side from the drive signal supply side of the first common electrode wiring pattern 121.

The one end of the common electrode wiring pattern 102 (that is, the leftmost side in FIG. 23) is connected to the wire 62 of the wiring member 60 via a second lead-out wire 31.

The first common electrode wiring pattern 121 and the second common electrode wiring pattern 122 of the common electrode wiring pattern 102, and the second lead-out wire can be formed of a foil of metal such as aluminum, gold, copper, nickel, and the like, subjected to patterning simultaneously. Alternatively, those metal foils patterned separately in different processes, can be electrically connected to each other.

If the electrical resistance of the lower electrode 13 serving as a common electrode is minimal, the lower electrode 13 as the common electrode can be used as the first common electrode wiring pattern 121 of the common electrode wiring pattern 102. In this case, both ends of the lower electrode 13 in the nozzle alignment direction are connected to each other by the second common electrode wiring pattern 122.

As structured as above, without providing the first electrode wiring pattern separately from the common electrode, effects of the present invention may be obtained, and the structure is simplified.

On the other hand, the driver IC 500 includes terminals 33 for a control signal input, power input, and GND connection, and is electrically connected to a group of wires 63 on the wiring member 60 that electrically connect to a group of wires 34.

The driver IC 500 receives a control signal sent from the controller via the wiring member 60, turns on and off the switching element (selector) disposed inside, and selects the piezoelectric element 11 to be supplied with the drive power or the drive signal.

The first lead-out wire 29, the second lead-out wire 31, and the group of wires 34 are connected to the wiring member 60.

The wires 61, 62 are connected to the controller and supply the individual electrode drive power to the first lead-out wire 29, the common electrode drive power or a GND to the second lead-out wire 31, and the group of wires 63 provides control signal, power supply and a GND of the driver IC 500 to the group of wires 34.

In the above description, the actuator substrate 20 has been described referring to a bottom half of FIG. 23. Specifically, there are two nozzle rows, and an upper half of FIG. 23 is similarly configured.

In the present tenth embodiment, because the first common electrode wiring pattern of the common electrode wiring pattern is electrically connected via both ends thereof with the second common electrode wiring pattern, the same effect and performance as described above may be obtained.

When the driver IC 500 is mounted via wire bonding, the driver IC 500 is secured to an area between a terminal 23 on the actuator substrate 20 and the individual electrode wiring pattern 101, or an area between the adjacent individual electrode wiring patterns 101, and the terminal of the driver IC 500 and the terminals 23, 25, and 33 on the actuator substrate 20 are connected via the bonding wire.

Also, as described above, the supply port 9 that communicates the common liquid chamber with the individual liquid chamber is disposed between the first common electrode wiring pattern 121 and the second common electrode wiring pattern 122 of the common electrode wiring pattern 102.

With this, space may be used effectively, so that the head can be formed in a compact shape.

Figure 25:
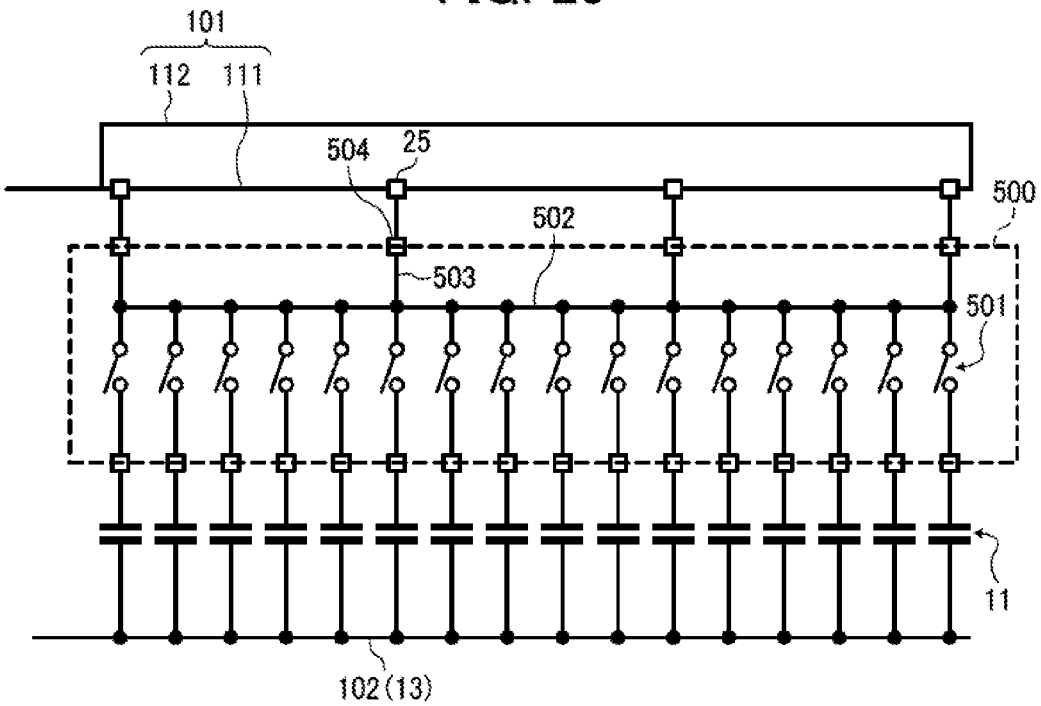
FIG. 25 illustrates an equivalent circuit according to an eleventh embodiment of the present invention.

FIG. 25 illustrates an equivalent circuit according to an eleventh embodiment.

In the present embodiment, the individual electrode wiring pattern 101 in the above tenth embodiment is configured to include the first individual electrode wiring pattern 111 and the second individual electrode wiring pattern 112 that electrically connects both ends of the first individual electrode wiring pattern 111 in the nozzle alignment direction.

The first individual electrode wiring pattern 111 includes at least two drive power input terminals 504, fewer in number than the switches 501 serving as the plurality of selectors.

On the other hand, as described in the eleventh embodiment, the plurality of selectors, that is, each of the switches 501 is connected to each other inside the driver IC 500 via the internal wire 502. In addition, the internal wire 502 includes the lead-out wire 503, and the drive power input terminal 504 to the side of the driver IC 500 is disposed to the lead-out wire 503.

Thus, the drive power input terminal 504 of the driver IC 500 and the drive power input terminal 25 of the first individual electrode wiring pattern 111 are connected.

At least two or more connecting portions, fewer in number than the switches 501 serving as the plurality of selectors, are constructed by the lead-out wire 503 of the driver IC 500, the drive power input terminal 504 connecting to the lead-out wire 503, and the drive power input terminal 25 of the first individual electrode wiring pattern 111.

Even in the present eleventh embodiment, because both ends of the first individual electrode wiring pattern 111 are electrically connected by the second individual electrode wiring pattern 112, similar effects and performance as those of each of the above described embodiments can be obtained.

Figure 26:
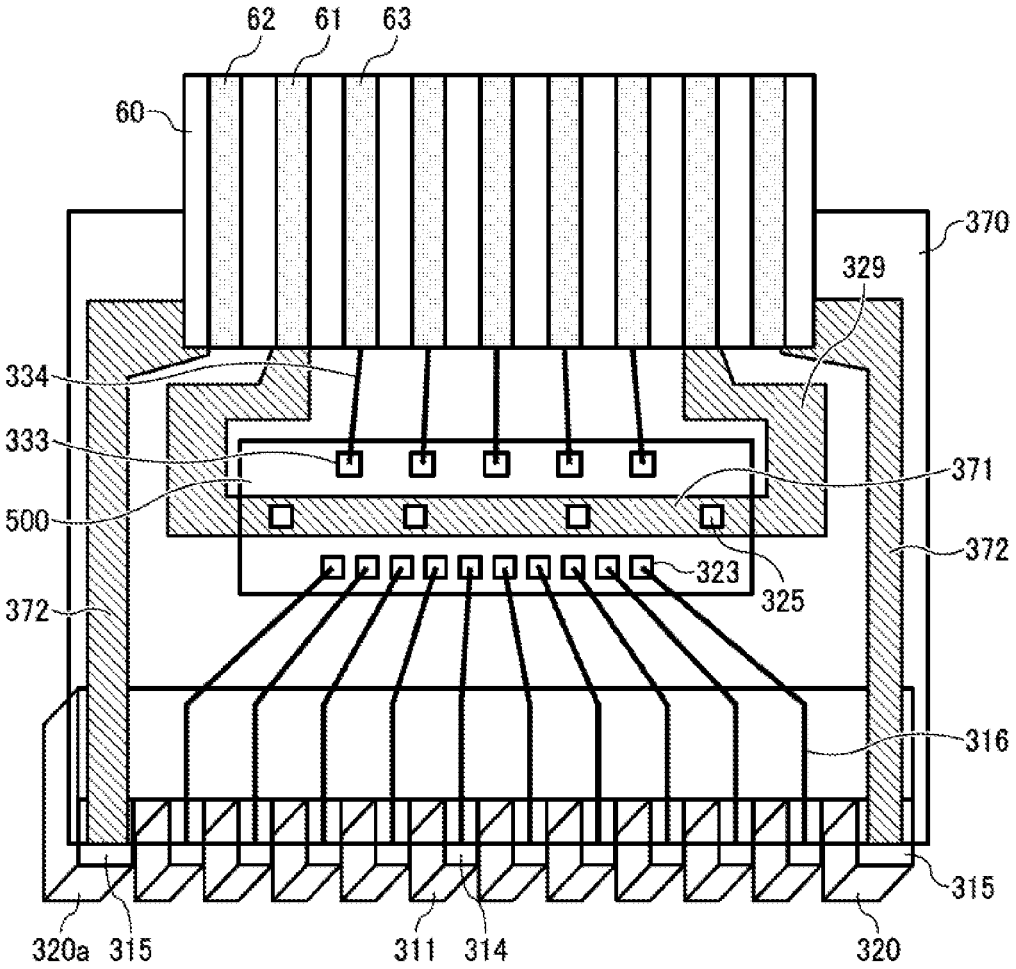
FIG. 26 illustrates a plan view of the wiring pattern according to a twelfth embodiment of the present invention.
Figure 27:
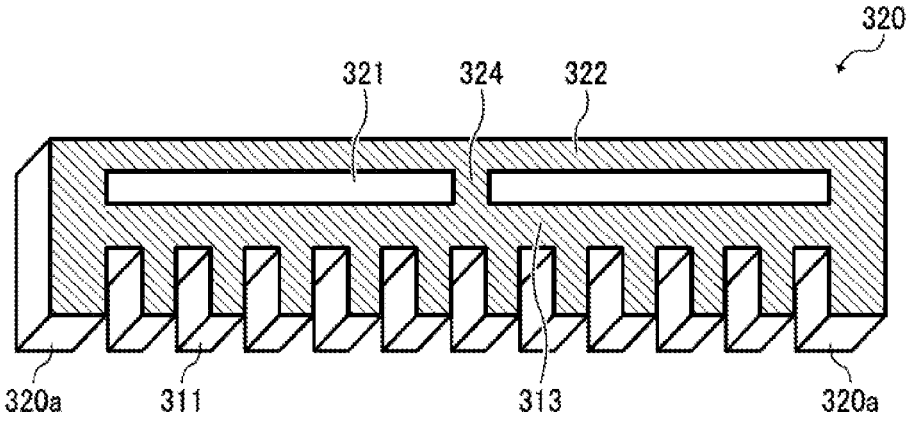
FIG. 27 is a perspective view of the piezoelectric member according to the twelfth embodiment of the present invention.

Next, a twelfth embodiment of the present invention will be described with reference to FIGS. 26 and 27. FIG. 26 illustrates a plan view of the wiring pattern according to the twelfth embodiment of the present invention; and FIG. 27 is a perspective view of the piezoelectric member in FIG. 26 seen from a rear side thereof.

In the present twelfth embodiment, there is provided a piezoelectric member 320 as an actuator member. The piezoelectric member 320 is processed by half-cut dicing so as to form a predetermined number of dentiform, column-shaped piezoelectric pillars 311. Each piezoelectric pillar 311 corresponds to the piezoelectric element 11 in each of the above embodiments, and connects to the vibration area of the diaphragm forming part of the individual liquid chamber, to which the nozzle is connected.

The piezoelectric member 320 has a layered structure in which piezoelectric films and internal electrodes are alternately laminated. The internal electrodes are alternately led out to different edge surfaces. One of the internal electrode connects to a common external electrode 313 disposed on one end surface of the piezoelectric member 320 in a direction perpendicular to the nozzle alignment direction, that is, the piezoelectric pillar alignment direction. The other internal electrode connects to an individual external electrode 314 disposed on the other end surface of the piezoelectric member 320.

Herein, at least part of the internal electrode of the piezoelectric pillars 320*a*, 320*a* at both ends in the nozzle alignment direction is lead out to both end surfaces, and the common external electrode 313 is connected, via the internal electrode, to a common lead-out electrode 315 disposed on an end surface of the individual external electrode 314.

Each of the common lead-out electrodes 315 is connected to each second wire 372 disposed on a film wiring member 370 formed of FPC, COF, TCP, and the like. The second wire 372 of the film wiring member 370 connects to the wire 62 of the wiring member 60.

With this structure, both ends of the common external electrode 313 in the nozzle alignment direction connect to the drive signal supply side of the piezoelectric pillar 311.

Both ends of the common external electrode 313 are electrically connected via a joint electrode 322, and a cross-linked electrode 324 electrically connects the common external electrode 313 to the joint electrode 322 between both ends of the common external electrode 313 in the nozzle alignment direction.

Herein, the wiring pattern formed on one end surface of the piezoelectric member 320 includes two slits 321 along the nozzle alignment direction, so that the common external electrode 313, the joint electrode 322, and the cross-linked electrode 324 are formed.

An individual wire 316 is disposed on the wiring member 370, and a tip end of the individual wire 316 is electrically connected to the individual external electrode 314 of the piezoelectric pillar 311 of the piezoelectric member 320 by soldering, ACF adhesion, conductive paste adhesion, and the like. Another end of the individual wire 316 is connected to a terminal 323 disposed on the wiring member 370 of the base side of the individual wire 316.

In addition, a first wire 371 is disposed along a row of the terminals 323 near the terminals 323 of the wiring member 370, and a plurality of terminals 325 is disposed on the first wire 371.

The driver IC 500 is so mounted as to cover the terminals 323 of the wiring member 370 and the first wire 371. Thus, the drive power supply input terminal of the driver IC 500 and the terminals 325 of the wiring member 370 are overlaid and electrically connected. Further, the drive power supply output terminal of the driver IC 500 and the terminals 323 of the wiring member 370 are overlaid and electrically connected.

Switching elements (that is, selectors), the number of which is equal to or greater than that of the drive power supply output terminals 323, connect to a lead-in wire drawn to an internal device of the driver IC 500 from the terminals 325 of the first wire 371 in parallel, so that the drive power supply output terminals 323 electrically connect to the driver IC 500 via the one or more switching elements.

A first lead-out wire 329 is drawn from both ends of the first wire 371. The first wire 371 is connected to the wire 61 of the wiring member 60 via the first lead-out wire 329.

The first wire 371 and the first lead-out wire 329 can be formed simultaneously by patterning, and alternatively, patterned separately in different processes to be electrically connected to each other.

The first wire 371 is connected to the wire 61 of the wiring member 60 via the first lead-out wire 329.

On the other hand, the driver IC 500 includes terminals 333 for a control signal input, power input, and GND connection, and is electrically connected to the terminals 63 on the wiring member 60 that electrically connect to a group of wires 334.

The driver IC 500 receives a control signal sent from the controller via the wiring member 60, turns on and off the switching element (selector) disposed inside, and selects the piezoelectric pillar 311 to be supplied with the drive power or the drive signal.

The wires 61, 62 are connected to the controller, so that the individual electrode drive power is supplied to the first wire 371, and the common electrode drive power or an earth GND is supplied to the second wire 372, the group of wires 63 supplies a control signal, power supply and an earth GND of the driver IC 500 to the group of wires 334.

Specifically, in the present embodiment, the drive signal is supplied from both sides of the common electrode in the nozzle alignment direction. The common electrode corresponds to the first wiring pattern in each of the aforementioned embodiments. Similarly, both ends of the common electrode in the nozzle alignment direction are electrically connected by a joint electrode that corresponds to the second wiring pattern. Further, in the nozzle alignment direction, a cross-linked electrode is disposed in the center portion, so that the common electrode and the joint electrode are connected.

With this configuration, the same effect as that of each of the aforementioned embodiments can be obtained.

Each of the above embodiments may be combined each other on a consistent basis.

Figure 28:
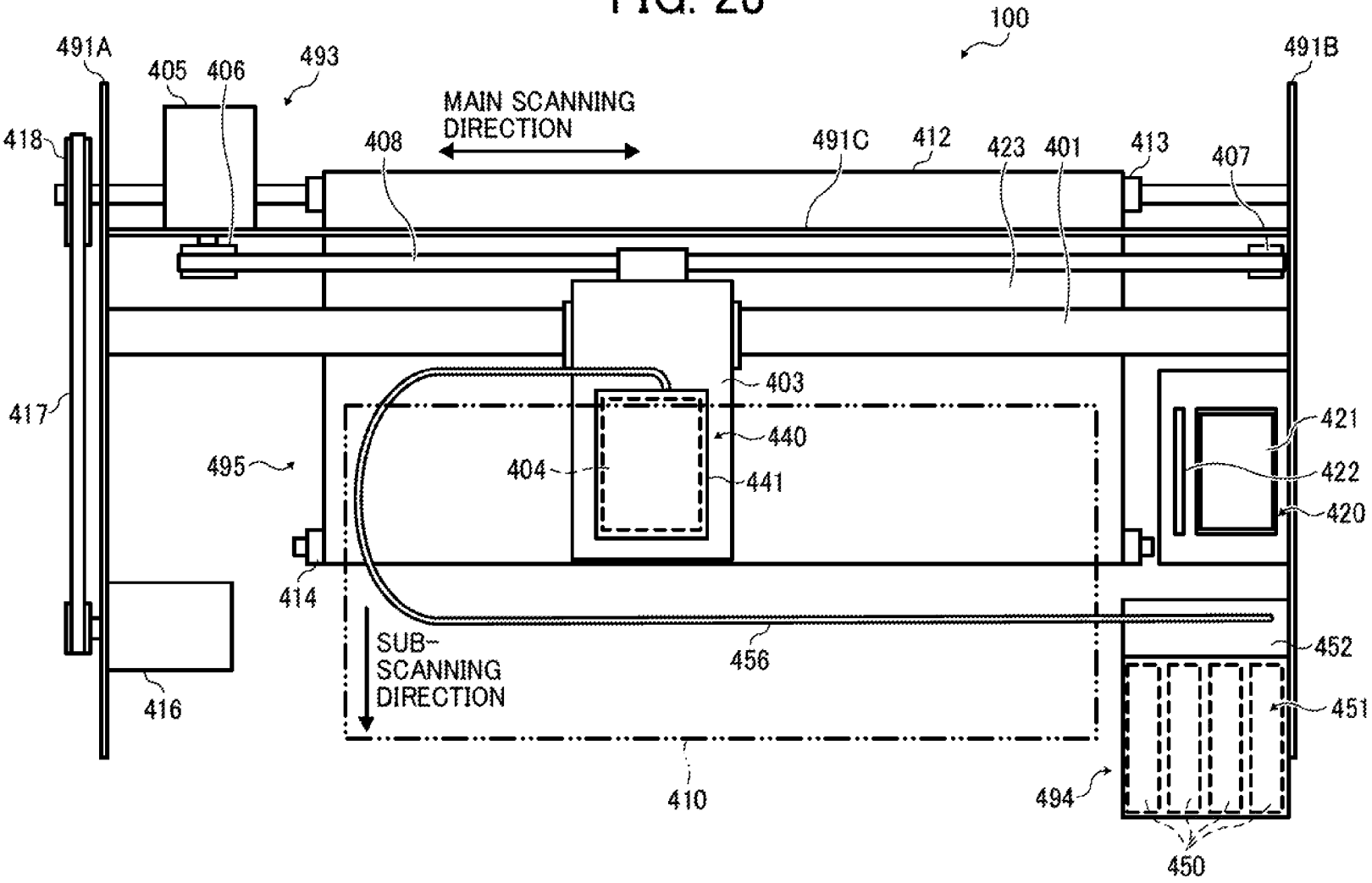
FIG. 28 is an exemplary liquid discharge apparatus according to the embodiments of the present invention.
Figure 29:
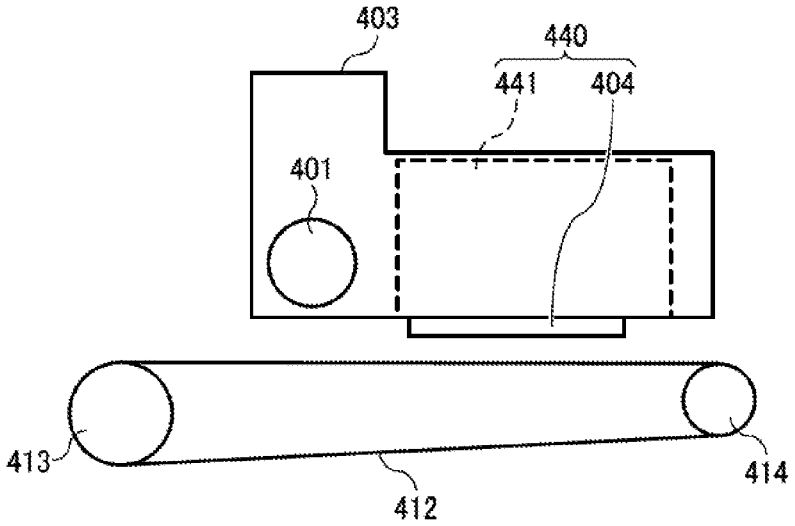
FIG. 29 schematically illustrates a side view of the liquid discharge apparatus of FIG. 28.

Next, an example of the liquid discharge apparatus according to the present invention will be described with reference to FIGS. 28 and 29. FIG. 28 is an explanatory plan view illustrating a principle part of the liquid discharge apparatus, and FIG. 29 is an explanatory side view of the same.

The present apparatus 100 is a serial-type apparatus so that the carriage 403 reciprocally moves in the main scanning direction by a main scan moving unit 493. The main scan moving unit 493 includes a guide 401, a main scan motor 405, a timing belt 408, and the like. The guide 401 is held on right and left side plates 491A, 491B and supports the carriage 403 to be movable. The main scan motor 405 moves the carriage 403 reciprocally in a main scanning direction via a timing belt 408 stretched between a driving pulley 406 and a driven pulley 407.

A liquid discharge head 404 and a head tank 441 integrally form a liquid discharge device 440 that is mounted on the carriage 403. The liquid discharge head 404 of the liquid discharge device 440 discharges ink droplets of each color of yellow (Y), cyan (C), magenta (M), and black (K). The liquid discharge head 404 includes nozzle arrays formed of a plurality of nozzles 11 arranged in a sub-scanning direction perpendicular to the main scanning direction, with the discharging head oriented downward.

The liquid stored outside the liquid discharge head 404 is supplied to the liquid discharge head 404 via a supply unit 494 that supplies the liquid from a liquid cartridge 450 to the head tank 441.

The supply unit 494 includes a cartridge holder 451 to mount a liquid cartridge 450 thereon, a tube 456, and a liquid feed unit 452 including a feed pump. The liquid cartridge 450 is detachably attached to the cartridge holder 451. The liquid is supplied to the head tank 441 by the liquid feed unit 452 via the tube 456 from the liquid cartridge 450.

The present apparatus includes a conveying unit 495 to convey a sheet 410. The conveying unit 495 includes a conveyance belt 412, and a sub-scan motor 416 to drive the conveyance belt 412.

The conveyance belt 412 electrostatically attracts the sheet 410 and conveys it at a position facing the liquid discharge head 404. The conveyance belt 412 is an endless belt and is stretched between a conveyance roller 413 and a tension roller 414. The sheet 410 is attracted to the conveyance belt 412 due to an electrostatic force or by air aspiration.

The conveyance belt 412 is caused to rotate in the sub-scanning direction driven by a rotation of the conveyance roller 413 via a timing belt 417 and a timing pulley 418 driven by the sub-scan motor 416.

Further, a maintenance unit 420 to maintain the liquid discharge head 404 in good condition is disposed on the side of the conveyance belt 412 at one side in the main scanning direction of the carriage 403.

The maintenance unit 420 includes, for example, a cap member 421 to cap a nozzle face (i.e., a surface on which the nozzle is formed) of the liquid discharge head 404; a wiper 422 to clean the nozzle face, and the like.

The main scan moving unit 493, the supply unit 494, the maintenance unit 420, and the conveying unit 495 are disposed to a housing that includes side plates 491A, 491B, and a rear plate 491C.

In the thus-configured liquid discharge apparatus, a sheet 410 is conveyed on and attracted to the conveyance belt 412 and is conveyed in the sub-scanning direction by the cyclic rotation of the conveyance belt 412.

Then, the liquid discharge heads 404 are driven in response to image signals while the carriage 403 moving in the main scanning direction, and a liquid is discharged to the stopped sheet 410, thereby forming an image.

As a result, because the liquid discharge apparatus includes the liquid discharge head according to preferred embodiments of the present invention, a constantly high quality image is formed.

Figure 30:
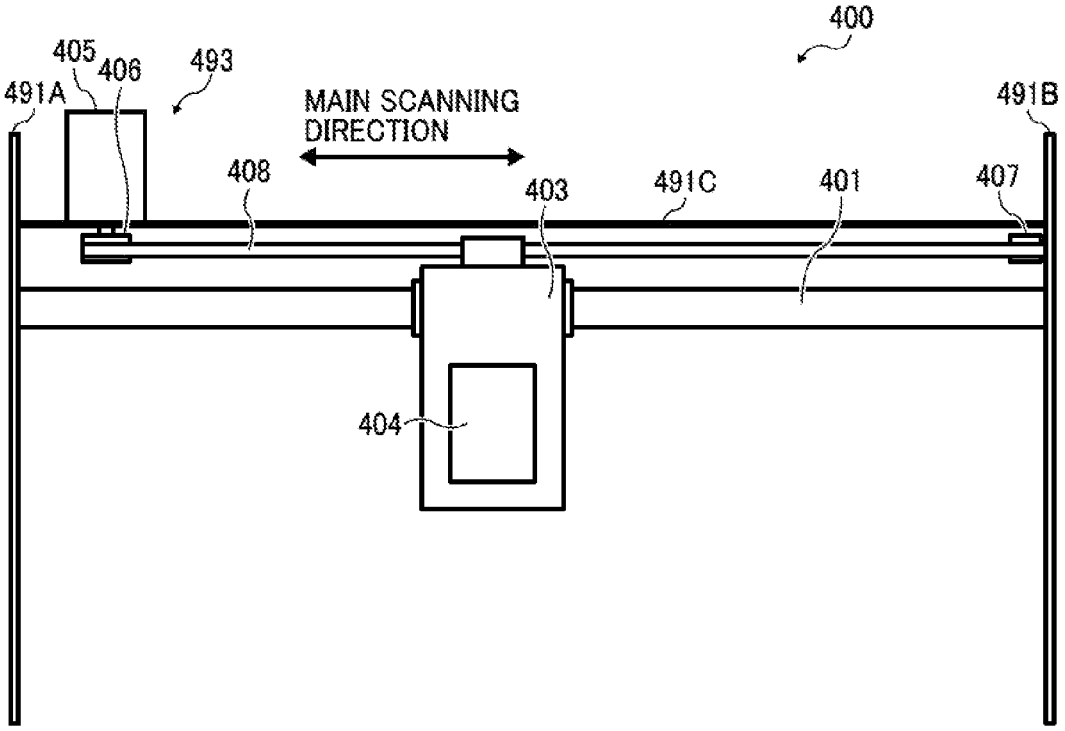
FIG. 30 is an example of a liquid discharge device.

Next, another example of the liquid discharge device according to the present invention will be described with reference to FIG. 30. FIG. 30 is a plan view illustrating a principal part of the liquid discharge device 400.

The liquid discharge device 400 includes the side plates 491A, 491B and the rear plate 491C; the main scan moving unit 493; the carriage 403; and the liquid discharge head 404.

This liquid discharge device 400 further including at least one of the maintenance unit 420 disposed, for example, on the side plate 491B, and the supply unit 494, may also be configured as a liquid discharge device 400.

Figure 31:
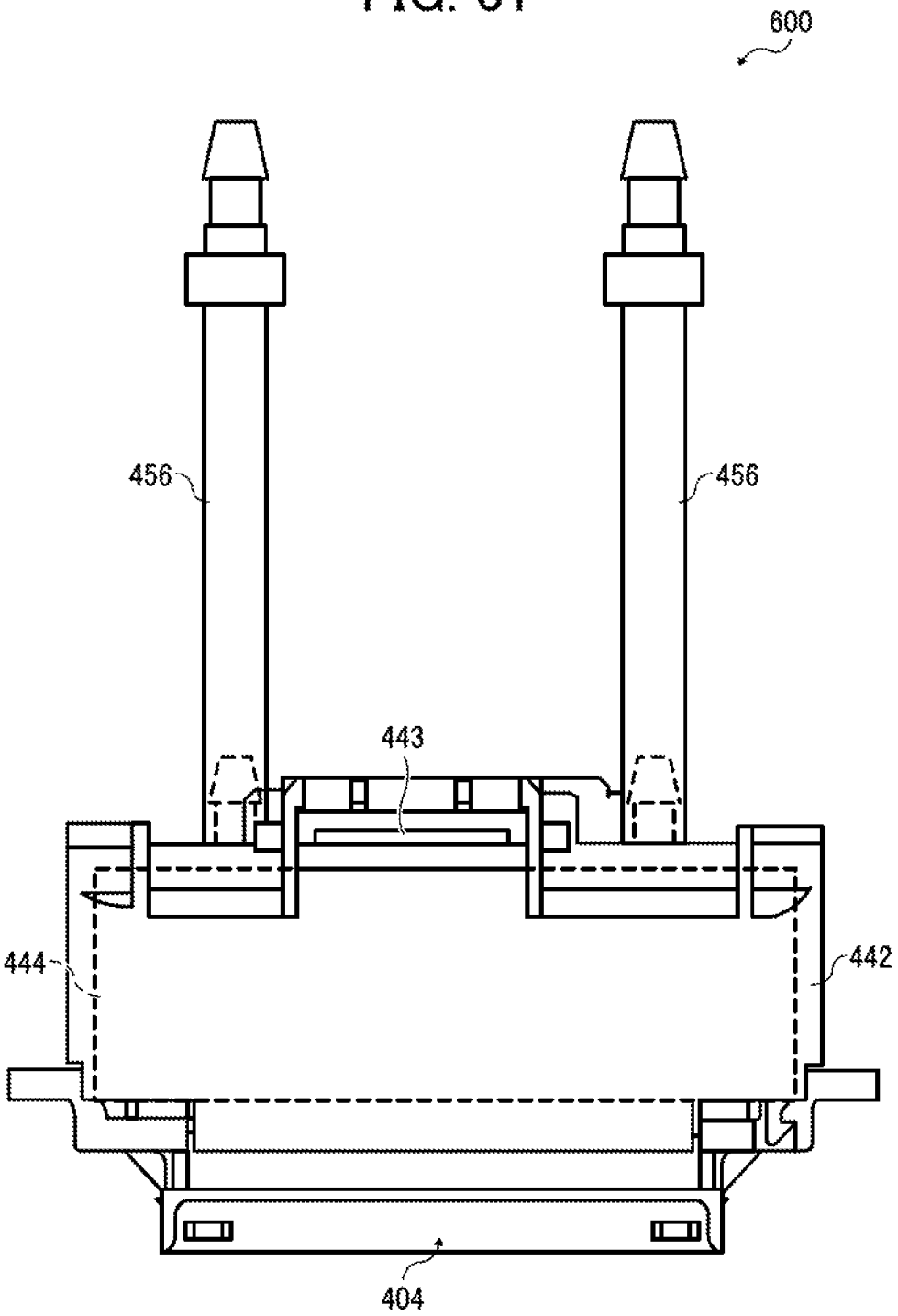
FIG. 31 is further another example of a liquid discharge device including the liquid discharge head, a channel member, and tubes connected to the channel member according to the embodiment of the present invention.

Next, another liquid discharge device according to the present embodiment will be described with reference to FIG. 31. FIG. 31 is a front view illustrating a principal part of the liquid discharge device 600.

The present liquid discharge device 600 includes the liquid discharge head 404 to which a channel member 444 is attached, and the tube 456 connected to the channel member 444.

Further, the channel member 444 is disposed inside a cover 442. Instead of the channel member 444, the liquid discharge device 600 may include the head tank 441. A connector 443 disposed above the channel member 444 electrically connects the liquid discharge head 404 with a power source.

In the embodiments of the present invention, the liquid discharge apparatus includes a liquid discharge head or a liquid discharge device, and drives the liquid discharge head to discharge a liquid. As the liquid discharge apparatus, there are an apparatus capable of discharging a liquid to materials on which the liquid can be deposited as well as an apparatus to discharge the liquid toward a space or liquid.

The liquid discharge apparatus may include devices to feed, convey, and discharge the material on which the liquid can be deposited. The liquid discharge apparatus may further include a pretreatment apparatus to coat a treatment liquid onto the material, and a post-treatment apparatus to coat the treatment liquid onto the material, onto which the liquid has been discharged.

Exemplary liquid discharge apparatuses may include, for example, an image forming apparatus to form an image on the sheet by discharging ink, and a three-dimensional apparatus to discharge a molding liquid to a powder layer in which powder material is formed in layers, so as to form a three-dimensional article.

In addition, the liquid discharge apparatus is not limited to such an apparatus to form and visualize images with letters or figures having meaning. Alternatively, the liquid discharge apparatus forms images without meaning such as patterns and three-dimensional objects.

The above materials on which the liquid can be deposited may include any material on which the liquid may be deposited even temporarily. Exemplary materials on which the liquid can be deposited may include paper, thread, fiber, fabric, leather, metals, plastics, glass, wood, ceramics, and the like, on which the liquid can be deposited even temporarily.

In addition, the liquid may include ink, a treatment liquid, DNA sample, resist, pattern material, binder, mold liquid, and the like.

Further, the exemplary liquid discharge apparatuses include, otherwise limited in particular, any of a serial-type apparatus to move the liquid discharge head and a line-type apparatus not to move the liquid discharge head.

The exemplary liquid discharge apparatuses include otherwise a treatment liquid coating apparatus to discharge the treatment liquid to the sheet to coat the treatment liquid on the surface of the sheet for the purpose of reforming a sheet surface, and an injection granulation apparatus in which a composition liquid including a raw materials dispersed in the solution is injected with the nozzle to granulate fine particles of the raw material.

The liquid discharge device is an integrated unit including the liquid discharge head and functional parts, or the liquid discharge head and other structures, and denotes an assembly of parts relative to the liquid discharge. For example, the liquid discharge device may be formed of a combination of the liquid discharge head with one of the head tank, carriage, supply unit, maintenance unit, and main scan moving unit.

Herein, examples of integrated unit include a liquid discharge head plus functional parts, of which structure is combined fixedly to each other through fastening, binding, and engaging, and ones movably held by the other parts. In addition, the liquid discharge head can be detachably attached to the functional parts or structures each other.

For example, an example of the liquid discharge device 440 as illustrated in FIG. 29 is integrally formed with the liquid discharge head and the head tank. Another example of the liquid discharge device is the integrally formed liquid discharge head and the head tank via the tube. A unit including a filter may further be added to a portion between the head tank and the liquid discharge head, thereby forming another liquid discharge device.

Further another example of the liquid discharge device is the liquid discharge head integrally formed with the carriage.

Still another example of the liquid discharge device includes the liquid discharge head movably held by the guide member that forms part of the main scan moving unit, so that the liquid discharge head and the main scan moving unit are integrally formed. Further, as illustrated in FIG. 30, the liquid discharge head, the carriage, and the main scan moving unit are integrally formed, thereby forming the liquid discharge device 400.

Furthermore, a cap member that forms part of the maintenance unit is fixed to the carriage on which the liquid discharge head is mounted, so that the liquid discharge head, the carriage, and the maintenance unit are integrally formed, thereby forming the liquid discharge device.

Further, the liquid discharge device 600 as illustrated in FIG. 31 includes the tube that is connected to the head tank or the channel member to which the liquid discharge head is attached, so that the liquid discharge head and the supply unit are integrally formed.

The main scan moving unit shall include a guide member itself. The supply unit shall include a tube itself, and a cartridge holder itself.

The pressure generating unit of the liquid discharge head is not limited in particular. For example, the piezoelectric actuator (layered-type piezoelectric element) may be used as described in the above exemplary embodiments. The pressure generator is not limited to the piezoelectric actuator, but may employ a thermal actuator that uses thermoelectric conversion elements such as a thermal resistor, and an electrostatic actuator formed of a vibration plate and an opposite electrode.

The term "image formation" means not only recording, but also printing, image printing, molding, and the like.

Additional modifications and variations of the present invention are possible in light of the above teachings. It is therefore to be understood that, within the scope of the appended claims, the invention may be practiced other than as specifically described herein.

What is claimed is:

1. A liquid discharge head, comprising:

a plurality of nozzles to discharge liquid droplets;

a plurality of pressure generators arranged one-by-one in an arrangement direction, each corresponding to a corresponding one of the plurality of nozzles and disposed along a nozzle alignment direction along which the plurality of nozzles is aligned;

an actuator member on which the plurality of pressure generators is aligned; and wiring disposed along the nozzle alignment direction, connected to the plurality of pressure generators, and included in the actuator member, the wiring including a first wiring pattern and a second wiring pattern, the first wiring pattern extending in the arrangement direction of the pressure generators and connected to each of the plurality of pressure generators, and the first wiring pattern including a near side proximal to and a far side distal from, in the arrangement direction of the pressure generators, a source of a drive signal for the pressure generators, wherein the second wiring pattern is connected to the near side and the far side of the first wiring pattern, and the first wiring pattern and the second wiring pattern connected to the near side and the far side of the first wiring pattern collectively forming a loop-shaped pattern that is connected to each of the plurality of pressure generators.

2. The liquid discharge head as claimed in claim 1, wherein for each position along the arrangement direction of the pressure generators, a width of the second wiring pattern is equal to or wider than that of the first wiring pattern.

3. The liquid discharge head as claimed in claim 1, further comprising a cross-linked wiring pattern to connect the first wiring pattern to the second wiring pattern at a portion between a position nearest to the drive signal source and a position farthest from the drive signal source of the first wiring pattern in the nozzle alignment direction.

4. The liquid discharge head as claimed in claim 3, wherein the cross-linked wiring pattern is disposed at a side farther from the drive signal source in the nozzle alignment direction than a mid-point between the position nearest to the drive signal source and the position farthest from the drive signal source of the first wiring pattern in the nozzle alignment direction.

5. The liquid discharge head as claimed in claim 1, wherein the first wiring pattern and the second wiring pattern are disposed on a same surface of the actuator member.

6. The liquid discharge head as claimed in claim 5, wherein the actuator member further comprises supply ports to supply a liquid to an individual liquid chamber with which the nozzle communicates, disposed between the first wiring pattern and the second wiring pattern.

7. The liquid discharge head as claimed in claim 6, further comprising a guard ring to prevent the first wiring pattern and the second wiring pattern from contacting the liquid, disposed around the supply ports of the actuator member.

8. The liquid discharge head as claimed in claim 1, wherein the first wiring pattern and the second wiring pattern are formed on different surfaces of the actuator member.

9. The liquid discharge head as claimed in claim 1, further comprising a common electrode shared by all the plurality of pressure generators, wherein the common electrode is the first wiring pattern.

10. The liquid discharge head as claimed in claim 9, wherein both ends of the common electrode in the nozzle alignment direction are connected to a source of a drive signal to be supplied to the pressure generators, both ends of the common electrode are electrically connected via a joint electrode, and a linking electrode to electrically connect the common electrode to the joint electrode is disposed between both ends of the common electrode.

11. A liquid discharge device comprising the liquid discharge head as claimed in claim 1.

12. The liquid discharge device as claimed in claim 11, wherein the liquid discharge head is formed with at least one of a head tank to store a liquid to be supplied to the liquid discharge head, a carriage to mount the liquid discharge head thereon, a supply unit to supply the liquid to the liquid discharge head, a maintenance unit to maintain the liquid discharge head, and a main scan moving unit to move the liquid discharge head in a main scanning direction.

13. A liquid discharge apparatus comprising the liquid discharge device as claimed in claim 11.

14. The liquid discharge head as claimed in claim 1, wherein the actuator member includes a diaphragm and a channel plate to form plural individual liquid chambers, each individual liquid chamber amongst the plural individual liquid chambers being aligned with, and disposed on an opposite side of the diaphragm to, a corresponding pressure generator amongst the plurality of pressure generators.

15. A liquid discharge head, comprising:

a plurality of nozzles to discharge liquid droplets;

a plurality of pressure generators arranged one-by-one in an arrangement direction, each corresponding to a corresponding one of the plurality of nozzles and disposed along a nozzle alignment direction along which the plurality of nozzles is aligned;

an actuator member on which the plurality of pressure generators is aligned; and wiring disposed along the nozzle alignment direction, connected to the plurality of pressure generators, and included in the actuator member, the wiring including a first wiring pattern to which each of the plurality of pressure generators is connected, the first wiring pattern including a near side proximal to and a far side distal from, in the arrangement direction of the pressure generators, a source of a drive signal for the pressure generators, wherein the near side and the far side are connected to a second wiring pattern, and the near side and the far side are connected to each other via the second wiring pattern, and wherein each pressure generator amongst the plurality of pressure generators arranged one-by-one in the arrangement direction comprises a lower electrode, an upper electrode, and a piezoelectric layer interposed between the lower and upper electrode of the pressure generator, and the wiring is connected with one of the lower electrode and the upper electrode.

* * * * *